US009752414B2

(12) United States Patent
Fripp et al.

(10) Patent No.: US 9,752,414 B2
(45) Date of Patent: Sep. 5, 2017

(54) WELLBORE SERVICING TOOLS, SYSTEMS AND METHODS UTILIZING DOWNHOLE WIRELESS SWITCHES

(71) Applicant: Halliburton Energy Services, Inc., Houston, TX (US)

(72) Inventors: Michael Linley Fripp, Carrollton, TX (US); Donald Kyle, Plano, TX (US); Archibald Linley Fripp, Williamsburg, VA (US); Zachary William Walton, Jr., Coppell, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 341 days.

(21) Appl. No.: 13/907,593

(22) Filed: May 31, 2013

(65) Prior Publication Data

US 2014/0352981 A1 Dec. 4, 2014

(51) Int. Cl.
*E21B 41/00* (2006.01)
*E21B 43/1185* (2006.01)
(Continued)

(52) U.S. Cl.
CPC ..... *E21B 41/0085* (2013.01); *E21B 43/1185* (2013.01); *E21B 47/12* (2013.01); *F42D 1/05* (2013.01)

(58) Field of Classification Search
CPC .... E21B 34/066; E21B 41/0085; E21B 47/12; E21B 47/122
See application file for complete search history.

(56) References Cited

U.S. PATENT DOCUMENTS 2,076,308 A 4/1937 Wells
2,189,936 A 2/1940 Brandfon
(Continued)

FOREIGN PATENT DOCUMENTS

WO 9925070 A2 5/1999
WO 0220942 A1 3/2002
(Continued)

OTHER PUBLICATIONS

National Instruments, Jan. 3, 2003 "What determines if a Transducer is Active or Passive?", http://digital.ni.com/public.nsf/allkb/084702CE98679BB886256CA3006752D7.*
(Continued)

*Primary Examiner* — David Andrews
(74) *Attorney, Agent, or Firm* — John W. Wustenberg; Baker Botts L.L.P.

(57) ABSTRACT

A wellbore tool comprising a power supply, an electrical load, a receiving unit configured to passively receive a triggering signal, and a switching system electrically coupled to the power supply, the receiving unit, and the electrical load, wherein the switching system is configured to selectively transition from an inactive state to an active state in response to the triggering signal, from the active state to the active state in response to the triggering signal, or combinations thereof, wherein in the inactive state a circuit is incomplete and any route of electrical current flow between the power supply and the electrical load is disallowed, and wherein in the active state the circuit is complete and at least one route of electrical current flow between the power supply and the electrical load is allowed.

17 Claims, 10 Drawing Sheets

(51) Int. Cl.
*E21B 47/12* (2012.01)
*F42D 1/05* (2006.01)

(56) References Cited

U.S. PATENT DOCUMENTS 2,189,937 A 2/1940 Broyles
2,308,004 A 1/1943 Hart
2,330,265 A 9/1943 Burt
2,373,006 A 4/1945 Baker
2,381,929 A 8/1945 Schlumberger
2,618,340 A 11/1952 Lynd
2,618,343 A 11/1952 Conrad
2,637,402 A 5/1953 Baker et al.
2,640,547 A 6/1953 Baker et al.
2,695,064 A 11/1954 Ragan et al.
2,715,444 A 8/1955 Fewel
2,871,946 A 2/1959 Bigelow
2,918,125 A 12/1959 Sweetman
2,961,045 A 11/1960 Stogner et al.
2,974,727 A 3/1961 Goodwin
3,029,873 A 4/1962 Hanes
3,055,430 A 9/1962 Campbell
3,076,928 A * 2/1963 Waters ..... 324/339
3,122,728 A 2/1964 Lindberg, Jr.
3,160,209 A 12/1964 Bonner
3,195,637 A 7/1965 Wayte
RE25,846 E 8/1965 Campbell
3,217,804 A 11/1965 Peter
3,233,674 A 2/1966 Leutwyler
3,266,575 A 8/1966 Owen
3,398,803 A 8/1968 Leutwyler et al.
3,556,211 A 1/1971 Bohn et al.
3,659,648 A 5/1972 Cobbs
3,737,845 A * 6/1973 Maroney ..... E21B 34/16 166/66.4
4,085,590 A 4/1978 Powell et al.
4,206,810 A 6/1980 Blackman
4,282,931 A 8/1981 Golben
4,352,397 A 10/1982 Christopher
4,377,209 A 3/1983 Golben
4,385,494 A 5/1983 Golben
4,402,187 A 9/1983 Golben et al.
4,598,769 A 7/1986 Robertson
4,796,699 A 1/1989 Upchurch
4,856,595 A 8/1989 Upchurch
4,884,953 A 12/1989 Golben
4,901,069 A * 2/1990 Veneruso ..... 340/854.8
5,024,270 A 6/1991 Bostick
5,040,602 A 8/1991 Helms
5,058,674 A 10/1991 Schultz et al.
5,074,940 A 12/1991 Ochi et al.
5,089,069 A 2/1992 Ramaswamy et al.
5,101,907 A 4/1992 Schultz et al.
5,117,548 A 6/1992 Griffith et al.
5,155,471 A 10/1992 Ellis et al.
5,163,521 A 11/1992 Pustanyk et al.
5,188,183 A 2/1993 Hopmann et al.
5,197,758 A 3/1993 Lund et al.
5,211,224 A 5/1993 Bouldin
5,238,070 A 8/1993 Schultz et al.
5,279,321 A 1/1994 Krimm
5,293,551 A * 3/1994 Perkins et al. ..... 361/154
5,316,081 A 5/1994 Baski et al.
5,316,087 A 5/1994 Manke et al.
5,355,960 A 10/1994 Schultz et al.
5,396,951 A 3/1995 Ross
5,452,763 A 9/1995 Owen
5,476,018 A 12/1995 Nakanishi et al.
5,485,884 A 1/1996 Hanley et al.
5,490,564 A 2/1996 Schultz et al.
5,531,845 A 7/1996 Flanigan et al.
5,558,153 A 9/1996 Holcombe et al.
5,573,307 A 11/1996 Wilkinson et al.
5,575,331 A 11/1996 Terrell
5,622,211 A 4/1997 Martin et al.
5,662,166 A 9/1997 Shammai
5,673,556 A 10/1997 Goldben et al.
5,687,791 A 11/1997 Beck et al.
5,700,974 A 12/1997 Taylor
5,725,699 A 3/1998 Hinshaw et al.
5,971,072 A 10/1999 Huber et al.
6,021,095 A * 2/2000 Tubel ..... E21B 23/00 166/166
6,061,000 A 5/2000 Edwards
6,128,904 A 10/2000 Rosso, Jr. et al.
6,137,747 A 10/2000 Shah et al.
6,160,492 A 12/2000 Herman
6,172,614 B1 1/2001 Robison et al.
6,186,226 B1 2/2001 Robertson
6,196,584 B1 3/2001 Shirk et al.
6,244,340 B1 6/2001 McGlothen et al.
6,315,043 B1 11/2001 Farrant et al.
6,333,699 B1 12/2001 Zierolf
6,364,037 B1 4/2002 Brunnert et al.
6,378,611 B1 4/2002 Helderle
6,382,234 B1 5/2002 Birckhead et al.
6,438,070 B1 8/2002 Birchak et al.
6,450,258 B2 9/2002 Green et al.
6,450,263 B1 9/2002 Schwendemann
6,470,996 B1 10/2002 Kyle et al.
6,536,524 B1 * 3/2003 Snider ..... 166/297
6,561,479 B1 5/2003 Eldridge
6,568,470 B2 5/2003 Goodson, Jr. et al.
6,583,729 B1 6/2003 Gardner et al.
6,584,911 B2 7/2003 Bergerson et al.
6,598,679 B2 7/2003 Robertson
6,619,388 B2 9/2003 Dietz et al.
6,651,747 B2 11/2003 Chen et al.
6,668,937 B1 12/2003 Murray
6,672,382 B2 1/2004 Schultz et al.
6,695,061 B2 2/2004 Fripp et al.
6,705,425 B2 3/2004 West
6,717,283 B2 4/2004 Skinner et al.
6,776,255 B2 8/2004 West et al.
6,848,503 B2 2/2005 Schultz et al.
6,880,634 B2 4/2005 Gardner et al.
6,915,848 B2 7/2005 Thomeer et al.
6,925,937 B2 8/2005 Robertson
6,971,449 B1 12/2005 Robertson
6,973,993 B2 12/2005 West et al.
6,998,999 B2 2/2006 Fripp et al.
7,012,545 B2 3/2006 Skinner et al.
7,063,146 B2 6/2006 Schultz et al.
7,063,148 B2 6/2006 Jabusch
7,068,183 B2 6/2006 Shah et al.
7,082,078 B2 7/2006 Fripp et al.
7,083,009 B2 8/2006 Paluch et al.
7,104,276 B2 9/2006 Einhaus
7,152,657 B2 12/2006 Bosma et al.
7,152,679 B2 12/2006 Simpson
7,165,608 B2 1/2007 Schultz et al.
7,191,672 B2 3/2007 Ringgenberg et al.
7,195,067 B2 3/2007 Manke et al.
7,197,923 B1 4/2007 Wright et al.
7,199,480 B2 4/2007 Fripp et al.
7,201,230 B2 4/2007 Schultz et al.
7,210,555 B2 5/2007 Shah et al
7,234,519 B2 6/2007 Fripp et al.
7,237,616 B2 7/2007 Patel
7,246,659 B2 7/2007 Fripp et al.
7,246,660 B2 7/2007 Fripp et al.
7,252,152 B2 8/2007 LoGiudice et al.
7,258,169 B2 8/2007 Fripp et al.
7,301,472 B2 11/2007 Kyle et al.
7,301,473 B2 11/2007 Shah et al.
7,322,416 B2 1/2008 Burris, II et al.
7,325,605 B2 2/2008 Fripp et al.
7,337,852 B2 3/2008 Manke et al.
7,339,494 B2 3/2008 Shah et al.
7,363,967 B2 4/2008 Burris, II et al.
7,367,394 B2 5/2008 Villareal et al.
7,372,263 B2 5/2008 Edwards
7,373,944 B2 5/2008 Smith et al.
7,387,165 B2 6/2008 Lopez de Cardenas et al.

(56) References Cited

U.S. PATENT DOCUMENTS 7,395,882 B2 7/2008 Oldham et al.
7,398,996 B2 7/2008 Saito et al.
7,404,416 B2 7/2008 Schultz et al.
7,428,922 B2 9/2008 Fripp et al.
7,431,335 B2 10/2008 Khandhadia et al.
7,472,589 B2 1/2009 Irani et al.
7,472,752 B2 1/2009 Rogers et al.
7,508,734 B2 3/2009 Fink et al.
7,510,017 B2 3/2009 Howell et al.
7,557,492 B2 7/2009 Fripp et al.
7,559,363 B2 7/2009 Howell et al.
7,559,373 B2 7/2009 Jackson et al.
7,595,737 B2 9/2009 Fink et al.
7,596,995 B2 10/2009 Irani et al.
7,604,062 B2 10/2009 Murray
7,610,964 B2 11/2009 Cox
7,617,871 B2 11/2009 Surjaatmadja et al.
7,624,792 B2 12/2009 Wright et al.
7,640,965 B2 1/2010 Bosma et al.
7,665,355 B2 2/2010 Zhang et al.
7,669,661 B2 3/2010 Johnson
7,673,506 B2 3/2010 Irani et al.
7,673,673 B2 3/2010 Surjaatmadja et al.
7,699,101 B2 4/2010 Fripp et al.
7,699,102 B2 4/2010 Storm et al.
7,712,527 B2 5/2010 Roddy
7,717,167 B2 5/2010 Storm et al.
7,730,954 B2 6/2010 Schultz et al.
7,777,645 B2 8/2010 Shah et al.
7,781,939 B2 8/2010 Fripp et al.
7,802,627 B2 9/2010 Hofman et al.
7,804,172 B2 9/2010 Schultz et al.
7,832,474 B2 11/2010 Nguy
7,836,952 B2 11/2010 Fripp
7,856,872 B2 12/2010 Irani et al.
7,878,255 B2 2/2011 Howell et al.
7,946,166 B2 5/2011 Irani et al.
7,946,340 B2 5/2011 Surjaatmadja et al.
7,963,331 B2 6/2011 Surjaatmadja et al.
7,987,914 B2 8/2011 Benton
8,040,249 B2 10/2011 Shah et al.
8,091,637 B2 1/2012 Fripp
8,118,098 B2 2/2012 Hromas et al.
8,140,010 B2 3/2012 Symons et al.
8,146,673 B2 4/2012 Howell et al.
8,162,050 B2 4/2012 Roddy et al.
8,191,627 B2 6/2012 Hamid et al.
8,196,515 B2 6/2012 Streibich et al.
8,196,653 B2 6/2012 Fripp et al.
8,215,404 B2 7/2012 Makowiecki et al.
8,220,545 B2 7/2012 Storm, Jr. et al.
8,225,014 B2 7/2012 Kuhl
8,235,103 B2 8/2012 Wright et al.
8,235,128 B2 8/2012 Dykstra et al.
8,240,384 B2 8/2012 Miller et al.
8,261,839 B2 9/2012 Fripp et al.
8,276,669 B2 10/2012 Dykstra et al.
8,276,675 B2 10/2012 Williamson et al.
8,284,075 B2 10/2012 Fincher et al.
8,297,367 B2 10/2012 Chen et al.
8,302,681 B2 11/2012 Fripp et al.
8,319,657 B2 11/2012 Godager
8,322,426 B2 12/2012 Wright et al.
8,327,885 B2 12/2012 Dykstra et al.
8,356,668 B2 1/2013 Dykstra et al.
8,376,047 B2 2/2013 Dykstra et al.
8,387,662 B2 3/2013 Dykstra et al.
8,397,803 B2 3/2013 Crabb et al.
8,403,068 B2 3/2013 Robison et al.
8,432,167 B2 4/2013 Reiderman
8,459,377 B2 6/2013 Moyes
8,472,282 B2 6/2013 Fink et al.
8,474,533 B2 7/2013 Miller et al.
8,479,831 B2 7/2013 Dykstra et al.
8,505,639 B2 8/2013 Robison et al.
8,517,113 B2 8/2013 Sheffield
8,544,564 B2 10/2013 Moore et al.
8,555,975 B2 10/2013 Dykstra et al.
8,584,762 B2 11/2013 Fripp et al.
8,602,100 B2 12/2013 Dykstra et al.
8,607,863 B2 12/2013 Fripp et al.
8,616,276 B2 12/2013 Tips et al.
8,616,290 B2 12/2013 Dykstra et al.
8,622,136 B2 1/2014 Dykstra et al.
8,636,062 B2 1/2014 Fripp et al.
8,708,056 B2 4/2014 Helms et al.
8,973,657 B2 3/2015 Miller et al.
8,991,486 B2 3/2015 Acosta et al.
9,010,442 B2 4/2015 Streich et al.
9,169,705 B2 10/2015 Helms et al.
9,284,817 B2 3/2016 Walton et al.
9,366,134 B2 6/2016 Walton et al.
9,562,429 B2 2/2017 Walton et al.
9,587,486 B2 3/2017 Walton et al.
9,587,487 B2 3/2017 Walton et al.
2002/0048135 A1 4/2002 Lerche et al.
2003/0213595 A1 11/2003 Jackson
2004/0108114 A1 6/2004 Lerche et al.
2004/0156264 A1 8/2004 Gardner et al.
2004/0227509 A1 11/2004 Ucan
2005/0241835 A1 11/2005 Burris, II et al.
2005/0260468 A1 11/2005 Fripp et al.
2005/0269083 A1 12/2005 Burris, II et al.
2006/0118303 A1 6/2006 Schultz et al.
2006/0144590 A1 7/2006 Lopez de Cardenas et al.
2007/0189452 A1 8/2007 Johnson et al.
2008/0135248 A1 6/2008 Talley et al.
2008/0137481 A1 6/2008 Shah et al.
2008/0202766 A1 8/2008 Howell et al.
2009/0192731 A1 7/2009 De Jesus et al.
2009/0308588 A1 12/2009 Howell et al.
2010/0065125 A1 3/2010 Telfer
2010/0084060 A1 4/2010 Hinshaw et al.
2010/0175867 A1* 7/2010 Wright ..... E21B 41/00 166/57
2010/0201352 A1 8/2010 Englert
2011/0042092 A1 2/2011 Fripp et al.
2011/0168390 A1 7/2011 Fripp et al.
2011/0174484 A1 7/2011 Wright et al.
2011/0174504 A1 7/2011 Wright et al.
2011/0199859 A1 8/2011 Fink et al.
2011/0214853 A1 9/2011 Robichaux et al.
2011/0248566 A1 10/2011 Purkis
2011/0253383 A1 10/2011 Porter et al.
2011/0266001 A1 11/2011 Dykstra et al.
2011/0308806 A9 12/2011 Dykstra et al.
2012/0001629 A1 1/2012 Hopper et al.
2012/0018167 A1 1/2012 Konopczynski et al.
2012/0048531 A1 3/2012 Marzouk et al.
2012/0075113 A1 3/2012 Loi et al.
2012/0111577 A1 5/2012 Dykstra et al.
2012/0146805 A1 6/2012 Vick, Jr. et al.
2012/0179428 A1 7/2012 Dykstra et al.
2012/0186819 A1 7/2012 Dagenais et al.
2012/0205120 A1 8/2012 Howell
2012/0205121 A1 8/2012 Porter et al.
2012/0211243 A1 8/2012 Dykstra et al.
2012/0234557 A1 9/2012 Dykstra et al.
2012/0241143 A1 9/2012 Wright et al.
2012/0255739 A1 10/2012 Fripp et al.
2012/0255740 A1 10/2012 Fripp et al.
2012/0279593 A1 11/2012 Fripp et al.
2012/0313790 A1 12/2012 Heijnen et al.
2012/0318511 A1 12/2012 Dykstra et al.
2012/0318526 A1 12/2012 Dykstra et al.
2013/0000922 A1 1/2013 Skinner et al.
2013/0014940 A1 1/2013 Fripp et al.
2013/0014941 A1 1/2013 Tips et al.
2013/0014955 A1 1/2013 Fripp et al.
2013/0020090 A1 1/2013 Fripp et al.
2013/0048290 A1 2/2013 Howell et al.
2013/0048291 A1 2/2013 Merron et al.
2013/0048298 A1 2/2013 Merron et al.
2013/0048301 A1 2/2013 Gano et al.

(56) References Cited

U.S. PATENT DOCUMENTS

| | | | |
|---|---|---|---|
| 2013/0075107 | A1 | 3/2013 | Dykstra et al. |
| 2013/0092382 | A1 | 4/2013 | Dykstra et al. |
| 2013/0092393 | A1 | 4/2013 | Dykstra et al. |
| 2013/0098614 | A1 | 4/2013 | Dagenais et al. |
| 2013/0106366 | A1 | 5/2013 | Fripp et al. |
| 2013/0112423 | A1 | 5/2013 | Dykstra et al. |
| 2013/0112424 | A1 | 5/2013 | Dykstra et al. |
| 2013/0112425 | A1 | 5/2013 | Dykstra et al. |
| 2013/0122296 | A1 | 5/2013 | Rose et al. |
| 2013/0140038 | A1 | 6/2013 | Fripp et al. |
| 2013/0153238 | A1 | 6/2013 | Fripp et al. |
| 2013/0180727 | A1 | 7/2013 | Dykstra et al. |
| 2013/0180732 | A1 | 7/2013 | Acosta et al. |
| 2013/0186634 | A1 | 7/2013 | Fripp et al. |
| 2013/0192829 | A1 | 8/2013 | Fadul et al. |
| 2013/0264053 | A1 | 10/2013 | Miller et al. |
| 2014/0102807 | A1 | 4/2014 | Zhao et al. |
| 2014/0238666 | A1 | 8/2014 | Walton et al. |
| 2014/0262234 | A1 | 9/2014 | Walton et al. |
| 2014/0262237 | A1 | 9/2014 | Walton et al. |
| 2014/0262320 | A1 | 9/2014 | Walton et al. |
| 2014/0262321 | A1 | 9/2014 | Fripp et al. |
| 2014/0262502 | A1 | 9/2014 | Walton et al. |
| 2014/0266772 | A1 | 9/2014 | Walton et al. |
| 2014/0352981 | A1 | 12/2014 | Walton et al. |

FOREIGN PATENT DOCUMENTS

| | | | |
|---|---|---|---|
| WO | 2004018833 | A1 | 3/2004 |
| WO | 2004099564 | A2 | 11/2004 |
| WO | 2009109788 | A1 | 9/2009 |
| WO | 2010002270 | A2 | 1/2010 |
| WO | 2010111076 | A2 | 9/2010 |
| WO | 2011021053 | A2 | 2/2011 |
| WO | 2011087721 | A1 | 7/2011 |
| WO | 2012078204 | A1 | 6/2012 |
| WO | 2012082248 | A1 | 6/2012 |
| WO | 2012161854 | A2 | 11/2012 |
| WO | 2013032687 | A2 | 3/2013 |
| WO | 2013032687 | A3 | 3/2013 |
| WO | 2014092836 | A1 | 6/2014 |
| WO | 2014163821 | A2 | 9/2014 |

OTHER PUBLICATIONS

Foreign communication from a related counterpart application—International Search Report and Written Opinion, PCT/US2013/061386, Apr. 10, 2014, 12 pages.

Danaher product information, Motion Brakes, http://www.danahermotion.com/website/usa/eng/products/clutches_and_brakes/115836.php, Mar. 4, 2009, 3 pages, Danaher Motion.

Filing receipt and specification for provisional patent application entitled "Wellbore Servicing Tools, Systems and Methods Utilizing Near-Field Communication," by Zachary William Walton, et al., filed Mar. 12, 2013 as U.S. Appl. No. 61/778,312.

Filing receipt and specification for patent application entitled "Remotely Activated Down Hole Systems and Methods," by Frank V. Acosta, et al., filed Mar. 7, 2012 as U.S. Appl. No. 13/414,016.

Filing receipt and specification for patent application entitled "External Casing Packer and Method of Performing Cementing Job," by Lonnie Helms, et al., filed Mar. 7, 2012 as U.S. Appl. No. 13/414,140.

Filing receipt and specification for patent application entitled "Method of Completing a Multi-Zone Fracture Stimulation Treatment of a Wellbore," by Steven G. Streich, et al., filed Sep. 21, 2012 as U.S. Appl. No. 13/624,173.

Filing receipt and specification for patent application entitled "Pressure Relief-Assisted Packer," by Lonnie Carl Helms, et al., filed Oct. 25, 2012 as U.S. Appl. No. 13/660,678.

Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/913,881.

Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,004.

Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,114.

Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,177.

Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,216.

Filing receipt and specification for patent application entitled "Wellbore Servicing Tools, Systems and Methods Utilizing Near-Field Communication," by Zachary William Walton, et al., filed Jun. 10, 2013 as U.S. Appl. No. 13/914,238.

Filing receipt and specification for International application entitled "Pressure Equalization for Dual Seat Ball Valve," filed Feb. 25, 2013 as International application No. PCT/US2013/027666.

Filing receipt and specification for International application entitled "Autofill and Circulation Assembly and Method of Using the Same," filed Feb. 25, 2013 as International application No. PCT/US2013/027674.

Foreign communication from a related counterpart application—International Search Report and Written Opinion, PCT/US2010/061047, Jun. 23, 2011, 7 pages.

Foreign communication from a related counterpart application—International Search Report and Written Opinion, PCT/US2011/036686, Nov. 30, 2011, 8 pages.

Foreign communication from a related counterpart application—International Preliminary Report on Patentability, PCT/US2011/036686, Jun. 12, 2013, 5 pages.

Foreign communication from a related counterpart application—International Search Report and Written Opinion, PCT/US2012/050762, Mar. 11, 2013, 12 pages.

Halliburton brochure entitled "Armada™ Sampling System," Sep. 2007, 2 pages.

Halliburton Drawing 672.03800, May 4, 1994, p. 1 of 2.

Halliburton Drawing 672.03800, May 4, 1994, p. 2 of 2.

Halliburton Drawing 626.02100, Apr. 20, 1999, 2 pages.

Magneta Electromagnetic Clutches and Brakes catalog, Jan. 2004, 28 pages, Magneta GmbH & Co KG.

Office Action dated Dec. 24, 2012 (26 pages), U.S. Appl. No. 12/688,058, filed Jan. 15, 2010.

Office Action dated Dec. 23, 2011 (34 pages), U.S. Appl. No. 12/688,058, filed Jan. 15, 2010.

Office Action dated Dec. 22, 2011 (30 pages), U.S. Appl. No. 12/965,859, filed Dec. 11, 2010.

Ogura product information, "Electromagnetic Clutch/Brake," http://www.ogura-clutch.com/products.html?category=2&by=type&no=1, Mar. 4, 2009, 4 pages, Ogura Industrial Corp.

Paus, Annika, "Near Field Communication in Cell Phones," Jul. 24, 2007, pp. 1-22 plus 1 cover and 1 content pages.

Sanni, Modiu L., et al., "Reservoir Nanorobots," Saudi Aramco Journal of Technology, Spring 2008, pp. 44-52.

Ward, Matt, et al., "RFID: Frequency, standards, adoption and innovation," JISC Technology and Standards Watch, May 2006, pp. 1-36.

Filing receipt and specification for patent application entitled "Dual Magnetic Sensor Actuation Assembly," by Zachary W. Walton, et al., filed Mar. 14, 2013 as U.S. Appl. No. 13/828,824.

Filing receipt and specification for patent application entitled "Method and Apparatus for Magnetic Pulse Signature Actuation," by Zachary W. Walton, et al., filed Feb. 28, 2013 as U.S. Appl. No. 13/781,093.

Office Action dated Dec. 3, 2013 (46 pages), U.S. Appl. No. 13/905,859, filed May 30, 2013.

(56) References Cited

OTHER PUBLICATIONS

Office Action dated Sep. 19, 2013 (17 pages), U.S. Appl. No. 12/688,058, filed Jan. 15, 2010.
Office Action dated Sep. 19, 2013 (30 pages), U.S. Appl. No. 12/965,859, filed Dec. 11, 2010.
Foreign communication from a related counterpart application—International Preliminary Report on Patentability, PCT/US2010/061047, Jul. 17, 2012, 5 pages.
Advisory Action dated Jul. 1, 2014 (3 pages), U.S. Appl. No. 12/688,058, filed Jan. 15, 2010.
Foreign communication from a related counterpart application—Australian Office Action, AU Application No. 2010341610, Feb. 27, 2014, 5 pages.
Notice of Allowance dated Jul. 15, 2014 (28 pages), U.S. Appl. No. 12/688,058, filed Jan. 15, 2010.
Office Action (Final) dated Mar. 10, 2014 (13 pages), U.S. Appl. No. 12/688,058, filed Jan. 15, 2010.
Office Action (Final) dated May 9, 2014 (16 pages), U.S. Appl. No. 12/965,859, filed Dec. 11, 2010.
Office Action (Final) dated Jul. 22, 2014 (21 pages), U.S. Appl. No. 13/905,859, filed May 30, 2013.
International Search Report and Written Opinion in related PCT Application No. PCT/US2014/039569, mailed on Jul. 16, 2015 (17 pages).
International Preliminary Report on Patentability issued in related PCT Application No. PCT/US2014/039569 mailed Dec. 10, 2015 (11 pages).

* cited by examiner

WELLBORE SERVICING TOOLS, SYSTEMS AND METHODS UTILIZING DOWNHOLE WIRELESS SWITCHES

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

In the performance of such a stimulation treatment and/or in the performance of one or more other wellbore operations (e.g., a drilling operation, a completion operation, a fluid-loss control operation, a cementing operation, production, or combinations thereof), it may be necessary to selectively manipulate one or more well tools which will be utilized in such operations. However, well tools conventionally employed in such wellbore operations are limited in their manner of usage and may be inefficient due to power consumption limitations. Moreover, tools conventionally employed may be limited as to their useful life and/or duration of use because of power availability limitations. As such, there exists a need for improved tools for use in wellbore operations and for methods and system of using such tools.

SUMMARY

Disclosed herein is a wellbore tool comprising a power supply, an electrical load, a receiving unit configured to passively receive a triggering signal, and a switching system electrically coupled to the power supply, the receiving unit, and the electrical load, wherein the switching system is configured to selectively transition from an inactive state to an active state in response to the triggering signal, from the active state to the active state in response to the triggering signal, or combinations thereof, wherein in the inactive state a circuit is incomplete and any route of electrical current flow between the power supply and the electrical load is disallowed, and wherein in the active state the circuit is complete and at least one route of electrical current flow between the power supply and the electrical load is allowed.

Also disclosed herein is a wellbore servicing system comprising one or more stationary receiving well tools disposed within a wellbore, wherein the stationary receiving well tools are configured to selectively transition from an inactive state to an active state in response to a triggering signal, wherein in the inactive state a circuit is incomplete and current flow between the power supply and the electrical load is disallowed, and wherein in the active state the circuit is complete and electrical current flow between the power supply and the electrical load is allowed, and a transitory transmitting well tool configured to be communicated through at least a portion of the wellbore, wherein the transitory transmitting well tool is configured to transmit the triggering signal to one or more stationary receiving well tools.

Further disclosed herein is a wellbore servicing method comprising positioning one or more stationary receiving well tools within a wellbore, wherein the stationary receiving well tools are each configured to selectively transition from an inactive state to an active state in response to a triggering signal, wherein in the inactive state a circuit is incomplete and any route of electrical current flow between the power supply and the electrical load is disallowed, and wherein in the activate state the circuit is complete and at least one route of electrical current flow between the power supply and the electrical load is allowed, communicating a transitory transmitting well tool through the wellbore such that the transitory transmitting well tool comes into signal communication with at least one of the one or more stationary receiving well tools, wherein the transitory transmitting well tool communicates with at least one of the one or more stationary receiving well tools via one or more triggering signals, and sensing the triggering signal to transition one or more stationary receiving well tools to the active state.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
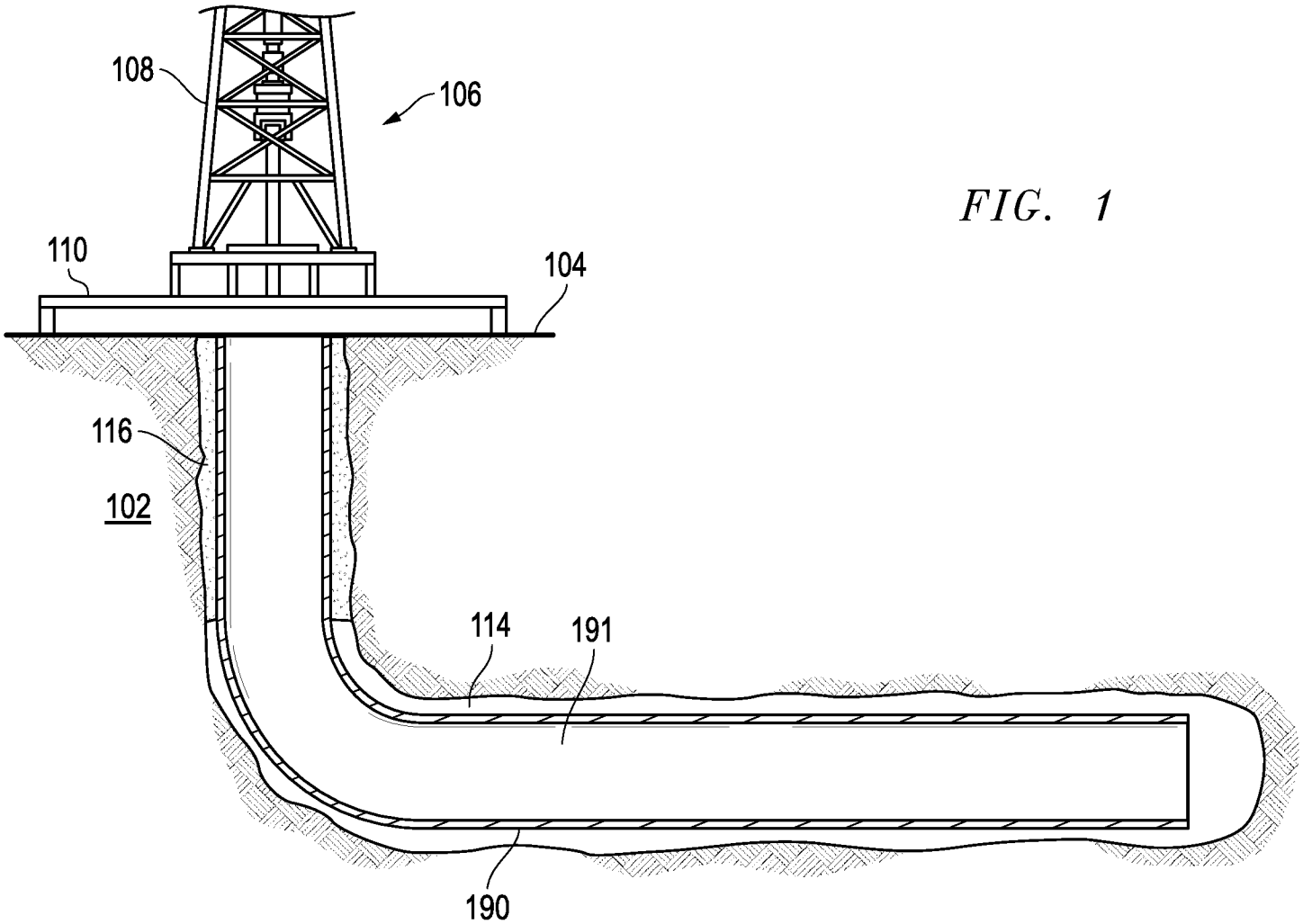
FIG. 1 is a representative partially cross-sectional view of a well system which may embody principles of this disclosure.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "downhole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are one or more embodiments of wellbore servicing systems and wellbore servicing methods to activate a well tool, for example, upon the communication of one or more triggering signals from a first well tool (e.g., a transmitting well tool) to a second well tool (e.g., a receiving well tool), for example, within a wellbore environment. In such embodiments, the one or more triggering signals may be effective to activate (e.g., to switch "on") one or more well tools utilizing a downhole wireless switch, as will be disclosed herein, for example, the triggering signal may be effective to induce a response within the downhole wireless switch so as to transition such a well tool from a configuration in which no electrical or electronic component associated with the tool receives power from a power source associated with the tool to a configuration in which one or more electrical or electronic components receive electrical power from the power source. Also disclosed herein are one or more embodiments of well tools that may be employed in such wellbore servicing systems and/or wellbore servicing methods utilizing a downhole wireless switch.

Referring to FIG. 1, an embodiment of an operating environment in which such a wellbore servicing system and/or wellbore servicing method may be employed is illustrated. It is noted that although some of the figures may exemplify horizontal or vertical wellbores, the principles of the methods, apparatuses, and systems disclosed herein may be similarly applicable to horizontal wellbore configurations, conventional vertical wellbore configurations, and combinations thereof. Therefore, the horizontal or vertical nature of any figure is not to be construed as limiting the wellbore to any particular configuration.

Referring to FIG. 1, the operating environment generally comprises a drilling or servicing rig 106 that is positioned on the earth's surface 104 and extends over and around a wellbore 114 that penetrates a subterranean formation 102, for example, for the purpose of recovering hydrocarbons from the subterranean formation 102, disposing of carbon dioxide within the subterranean formation 102, injecting stimulation fluids within the subterranean formation 102, or combinations thereof. The wellbore 114 may be drilled into the subterranean formation 102 by any suitable drilling technique. In an embodiment, the drilling or servicing rig 106 comprises a derrick 108 with a rig floor 110 through which a completion string 190 (e.g., a casing string or liner) generally defining an axial flowbore 191 may be positioned within the wellbore 114. The drilling or servicing rig 106 may be conventional and may comprise a motor driven winch and other associated equipment for lowering a tubular, such as the completion string 190 into the wellbore 114, for example, so as to position the completion equipment at the desired depth.

While the operating environment depicted in FIG. 1 refers to a stationary drilling or servicing rig 106 and a land-based wellbore 114, one of ordinary skill in the art will readily appreciate that mobile workover rigs, wellbore completion units (e.g., coiled tubing units) may be similarly employed. One of ordinary skill in the art will also readily appreciate that the systems, methods, tools, and/or devices disclosed herein may be employed within other operational environments, such as within an offshore wellbore operational environment.

In an embodiment the wellbore 114 may extend substantially vertically away from the earth's surface 104 over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved.

In an embodiment, at least a portion of the completion string 190 may be secured into position against the formation 102 in a conventional manner using cement 116. Additionally or alternatively, at least a portion of the completion string may be secured into position with a packer, for example a mechanical or swellable packer (such as Swell-Packers™, commercially available from Halliburton Energy Services). In additional or alternative embodiments, the wellbore 114 may be partially completed (e.g., partially cased and cemented) thereby resulting in a portion of the wellbore 114 being uncompleted (e.g., uncased and/or uncemented) or the wellbore may be uncompleted.

In an embodiment, as will be disclosed herein, one or more well tools may be incorporated within the completion string 190. For example, in such an embodiment, one or more selectively actuatable wellbore stimulation tools (e.g., fracturing tools), selectively actuatable wellbore isolation tools, or the like may be incorporated within the completion string 190. Additionally or alternatively, in an embodiment, one or more other wellbore servicing tools (e.g., a sensor, a logging device, an inflow control device, the like, or combinations thereof) may be similarly incorporated within the completion string 190.

It is noted that although the environment illustrated with respect to FIG. 1 illustrates a completion string 190 disposed within the wellbore 114, in one or more embodiments, any other suitable wellbore tubular such as a casing string, a work string, a liner, a drilling string, a coiled tubing string, a jointed tubing string, the like, or combinations thereof, may additionally or alternatively be disposed within the wellbore 114.

In an embodiment, a well tool may be configured as a transmitting well tool, that is, such that the transmitting well tool is configured to transmit a triggering signal to one or more other well tools (e.g., a receiving well tool). For example, a transmitting well tool may comprise a transmitter system, as will be disclosed herein. Alternatively, a well tool may be configured as a receiving well tool, that is, such that the receiving well tool is configured to receive a triggering signal from another well tool (e.g., a transmitting well tool). For example, a receiving well tool may comprise a receiver system, as will be disclosed herein. Alternatively, a well tool may be configured as a transceiver well tool, that is, such that the transceiver well tool (e.g., a transmitting/receiving well tool) is configured to both receive a triggering signal and to transmit a triggering signal. For example, the transceiver tool may comprise a receiver system and a transmitter system, as will be disclosed herein.

In an embodiment, as will be disclosed herein, a transmitting well tool may be configured to transmit a triggering signal to a receiving well tool and, similarly, a receiving well tool may be configured to receive the triggering signal, particularly, to passively receive the triggering signal. For example, in an embodiment, upon receiving the triggering signal, the receiving well tool may be transitioned from an inactive state to an active state. In such an inactive state, a circuit associated with the well tool is incomplete and any route of electrical current flow between a power supply associated with the well tool and an electrical load associated with the well tool is disallowed (e.g., no electrical or electronic component associated with the tool receives power from the power source). Also, in such an active state, the circuit is complete and the route of electrical current flow between the power supply and the electrical load is allowed (e.g., one or more electrical or electronic components receive electrical power from the power source).

In an embodiment, two or more well tools (e.g., a transmitting well tool and a receiving well tool) may be configured to communicate via a suitable signal. For example, in an embodiment, two or more well tools may be configured to communicate via a triggering signal, as will be disclosed herein. In an embodiment, the triggering signal may be generally defined as a signal sufficient to be sensed by a receiver portion of a well tool and thereby invoke a response within the well tool, as will be disclosed herein. Particularly, in an embodiment, the triggering signal may be effective to induce an electrical response within a receiving well tool, upon the receipt thereof, and to transition the receiving well tool from a configuration in which no electrical or electronic component associated with the receiving well tool receives power from a power source associated with the receiving well tool to a configuration in which one or more electrical or electronic components receive electrical power from the power source. For example the triggering signal may be formed of an electromagnetic (EM) signal, an energy signal, or any other suitable signal type which may be received or sensed by a receiving well tool and induce an electrical response as would be appreciated by one of ordinary skill in the art upon viewing this disclosure.

As used herein, the term "EM signal" refers to wireless signal having one or more electrical and/or magnetic characteristics or properties, for example, with respect to time. Additionally, the EM signal may be communicated via a transmitting and/or a receiving antenna (e.g., an electrical conducting material, such as, a copper wire). For example, the EM signal may be receivable and transformable into an electrical signal (e.g., an electrical current) via a receiving antenna (e.g., an electrical conducting material, for example, a copper wire). Further, the EM signal may be transmitted at a suitable magnitude of power transmission as would be appreciated by one of ordinary skill in the art upon viewing this disclosure. In an embodiment, the triggering signal is an EM signal and is characterized as having any suitable type and/or configuration of waveform or combinations of waveforms, having any suitable characteristics or combinations of characteristics. For example, the triggering signal may be transmitted at a predetermined frequency, for example, at a frequency within the radio frequency (RF) spectrum. In an embodiment, the triggering signal comprises a frequency between about 3 hertz (Hz) to 300 gigahertz (GHz), for example, a frequency of about 10 kilohertz (kHz).

In an additional or alternative embodiment, the triggering signal may be an energy signal. For example, in an embodiment, the triggering signal may comprise a signal from an energy source, for example, an acoustic signal, an optical signal, a magnetic signal, or any other energy signal as would be appreciated by one of ordinary skill in the art upon viewing this disclosure. Alternatively, the triggering signal may be an electrical signal communicated via one or more electrical contacts.

In an embodiment, and not intending to be bound by theory, the triggering signal is received or sensed by a receiver system and is sufficient to cause an electrical response within the receiver system, for example, the triggering signal induces an electrical current to be generated via an inductive coupling between a transmitter system and the receiver system. In such an embodiment, the induced electrical response may be effective to activate one or more electronic switches of the receiver system to allow one or more routes of electrical current flow within the receiver system to supply power to an electrical load, as will be disclosed herein.

In an embodiment, a given well tool (e.g., a receiving well tool and/or a transmitting well tool) may comprise one or more electronic circuits comprising a plurality of functional units. In an embodiment, a functional unit (e.g., an integrated circuit (IC)) may perform a single function, for example, serving as an amplifier or a buffer. The functional unit may perform multiple functions on a single chip. The functional unit may comprise a group of components (e.g., transistors, resistors, capacitors, diodes, and/or inductors) on an IC which may perform a defined function. The functional unit may comprise a specific set of inputs, a specific set of outputs, and an interface (e.g., an electrical interface, a logical interface, and/or other interfaces) with other functional units of the IC and/or with external components. In some embodiments, the functional unit may comprise repeated instances of a single function (e.g., multiple flip-flops or adders on a single chip) or may comprise two or more different types of functional units which may together provide the functional unit with its overall functionality. For example, a microprocessor or a microcontroller may comprise functional units such as an arithmetic logic unit (ALU), one or more floating-point units (FPU), one or more load or store units, one or more branch prediction units, one or more memory controllers, and other such modules. In some embodiments, the functional unit may be further subdivided into component functional units. A microprocessor or a microcontroller as a whole may be viewed as a functional unit of an IC, for example, if the microprocessor shares circuit with at least one other functional unit (e.g., a cache memory unit).

The functional units may comprise, for example, a general purpose processor, a mathematical processor, a state machine, a digital signal processor, a video processor, an audio processor, a logic unit, a logic element, a multiplexer, a demultiplexer, a switching unit, a switching element an input/output (I/O) element, a peripheral controller, a bus, a bus controller, a register, a combinatorial logic element, a storage unit, a programmable logic device, a memory unit, a neural network, a sensing circuit, a control circuit, a digital to analog converter (DAC), an analog to digital converter (ADC), an oscillator, a memory, a filter, an amplifier, a mixer, a modulator, a demodulator, and/or any other suitable devices as would be appreciated by one of ordinary skill in the art.

In the embodiments of FIGS. 2-3 & 8-9, a given well tool (e.g., a receiving well tool and/or a transmitting well tool) may comprise a plurality of distributed components and/or functional units and each functional unit may communicate with one or more other functional units via a suitable signal conduit, for example, via one or more electrical connections, as will be disclosed herein. In an embodiment, a given well tool comprises a plurality of interconnected functional units, for example, for transmitting and/or receiving one or more triggering signals and/or responding to one or more triggering signals.

In an embodiment where the well tool comprises a receiving well tool, the receiving well tool may comprise a receiver system 200 configured to receive a triggering signal. In an embodiment, the receiver system 200 may be configured to transition a switching system from an inactive state to an active state to supply power to an electrical load, in response to the triggering signal. For example, in the inactive state the well tool may be configured to substantially consume no power, for example, less power consumption than a conventional "sleep" or idle state. The inactive state may also be characterized as being an incomplete circuit and thereby disallows a route of electrical current flow between a power supply and an electrical load, as will be disclosed herein. Alternatively, in the active state the well tool may be configured to provide and/or consume power, for example, to perform one or more wellbore servicing operations, as will be disclosed herein. The active state may also be characterized as being a complete circuit and thereby allows a route of electrical current flow between a power supply and an electrical load, as will be disclosed herein.

Figure 2:
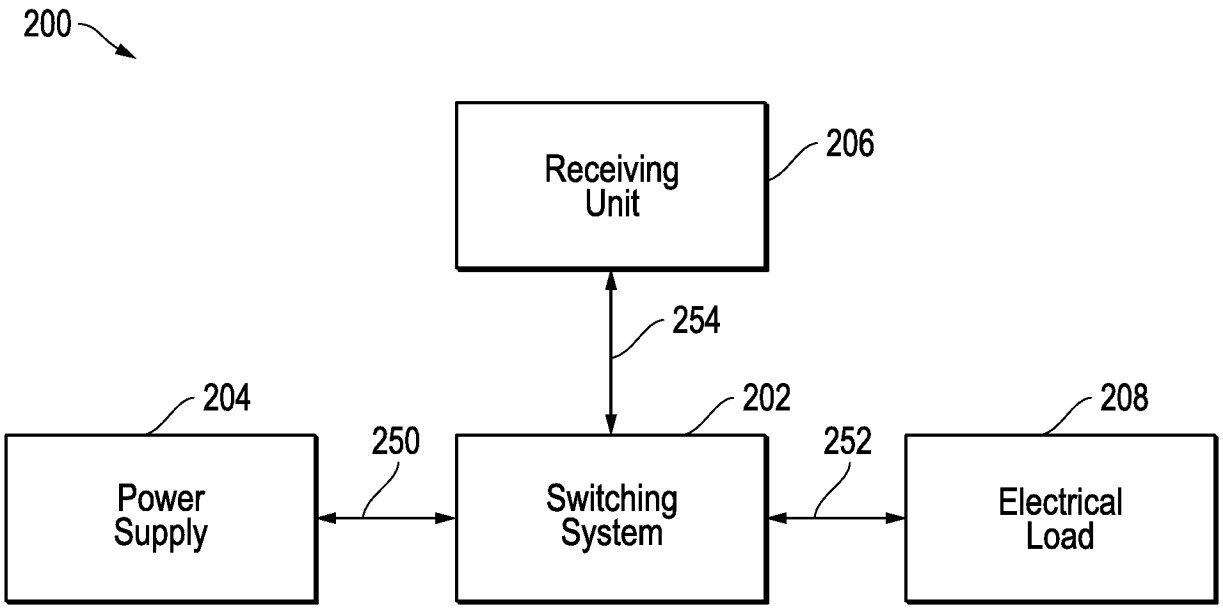
FIG. 2 is a block diagram view of an embodiment of an electronic circuit comprising a switching system.

In the embodiment of FIG. 2, the receiver system 200 may generally comprise various functional units including, but not limited to a receiving unit 206, a power supply 204, a switching system 202, and an electrical load 208. For example, in the embodiment of FIG. 2, the switching system 202 may be in electrical signal communication with the receiving unit 206 (e.g., via electrical connection 254), with the power supply 204 (e.g., via electrical connection 250), and with the electrical load 208 (e.g., via electrical connection 252).

In an alternative embodiment, the well tool may comprise various combinations of such functional units (e.g., a switching system, a power supply, an antenna, and an electrical load, etc.). While FIG. 2 illustrates a particular embodiment of a receiver system comprising a particular configuration of functional units, upon viewing this disclosure one of ordinary skill in the art will appreciate that a receiver system as will be disclosed herein may be similarly employed with alternative configurations of functional units.

In an embodiment, the receiving unit 206 may be generally configured to passively receive and/or passively sense a triggering signal. As such, the receiving unit 206 is a passive device and is not electrically coupled to a power source or power supply. For example, the receiving unit 206 does not require electrical power to operate and/or to generate an electrical response. Additionally, the receiving unit 206 may be configured to convert an energy signal (e.g., a triggering signal) to a suitable output signal, for example, an electrical signal sufficient to activate the switching system 202.

In an embodiment, the receiving unit 206 may comprise the one or more antennas. The antennas may be configured to receive a triggering signal, for example, an EM signal. For example, the antennas may be configured to be responsive to a triggering signal comprising a frequency within the RF spectrum (e.g., from about 3 Hz to 300 GHz). In an embodiment, the antennas may be responsive to a triggering signal within the 10 kHz band. In an additional or alternative embodiment, the antennas may be configured to be responsive to any other suitable frequency band as would be appreciated by one of ordinary skill in the art upon viewing this disclosure. The antennas may generally comprise a monopole antenna, a dipole antenna, a folded dipole antenna, a patch antenna, a microstrip antenna, a loop antenna, an omnidirectional antenna, a directional antenna, a planar inverted-F antenna (PIFA), a folded inverted conformal antenna (FICA), any other suitable type and/or configuration of antenna as would be appreciated by one of ordinary skill in the art upon viewing this disclosure, or combinations thereof. For example, the antenna may be a loop antenna and, in response to receiving a triggering signal of about a predetermined frequency, the antenna may inductively couple and/or generate a magnetic field which may be converted into an electrical current or an electrical voltage (e.g., via inductive coupling). Additionally, the antennas may comprise a terminal interface and/or may be configured to physically and/or electrically connect to one or more functional units, for example, the switching system 202 (as shown in FIG. 2). For example, the terminal interface may comprise one or more wire leads, one or more metal traces, a BNC connector, a terminal connector, an optical connector, and/or any other suitable connection interfaces as would be appreciated by one of ordinary skill in the art upon viewing this disclosure.

In an alternative embodiment, the receiving unit 206 may comprise one or more passive transducers as an alternative to the antenna. For example, a passive transducer may be in electrical signal communication with the switching system 202 and may be employed to experience a triggering signal (e.g., an acoustic signal, an optical signal, a magnetic signal, etc.) and to output a suitable signal (e.g., an electrical signal sufficient to activate the switching system 202) in response to sensing and/or detecting the triggering signal. For example, suitable transducers may include, but are not limited to, acoustic sensors, accelerometers, capacitive sensors, piezoresistive strain gauge sensors, ferroelectric sensors, electromagnetic sensors, piezoelectric sensors, optical sensors, a magneto-resistive sensor, a giant magneto-resistive (GMR) sensor, a microelectromechanical systems (MEMS) sensor, a Hall-effect sensor, a conductive coils sensor, or any other suitable type of transducers as would be appreciated by one of ordinary skill in the art upon viewing this disclosure.

Additionally, in an embodiment, the antennas or sensors may be electrically coupled to a signal conditioning filter (e.g., a low-pass filter, a high-pass filter, a band-pass filter, and/or a band-stop filter). In such an embodiment, the signal conditioning filter may be employed to remove and/or substantially reduce frequencies outside of a desired frequency range and/or bandwidth. For example, the signal conditioning filter may be configured to reduce false positives caused by signals having frequencies outside of the desired frequency range and/or bandwidth.

In an embodiment, the power supply (e.g., the power supply 204) may supply power to the switching system 202 and/or any other functional units of the well tool. Additionally, the power supply 204 may supply power to the load when enabled by the switching system 202. The power supply may comprise an on-board battery, a renewable power source, a voltage source, a current source, or any other suitable power source as would be appreciated by one of ordinary skill in the art upon viewing this disclosure. For example, the power source is a Galvanic cell. Additionally, in such an embodiment, the power supply may be configured to supply any suitable voltage, current, and/or power required to power and/operate the electrical load 208. For example, in an embodiment, the power supply may supply power in the range of about 0.5 watts to 10 watts, alternatively, from about 0.5 watts to about 1.0 watts. Additionally or alternatively, the power supply may supply voltage in the range of about 0.5 volts (V) to 1.5 V, alternatively, from about 0.5 V to 3.7 V, alternatively, from about 0.5 V to 8V, alternatively, from about 0.5 V to 40 V, etc.

Figure 3:
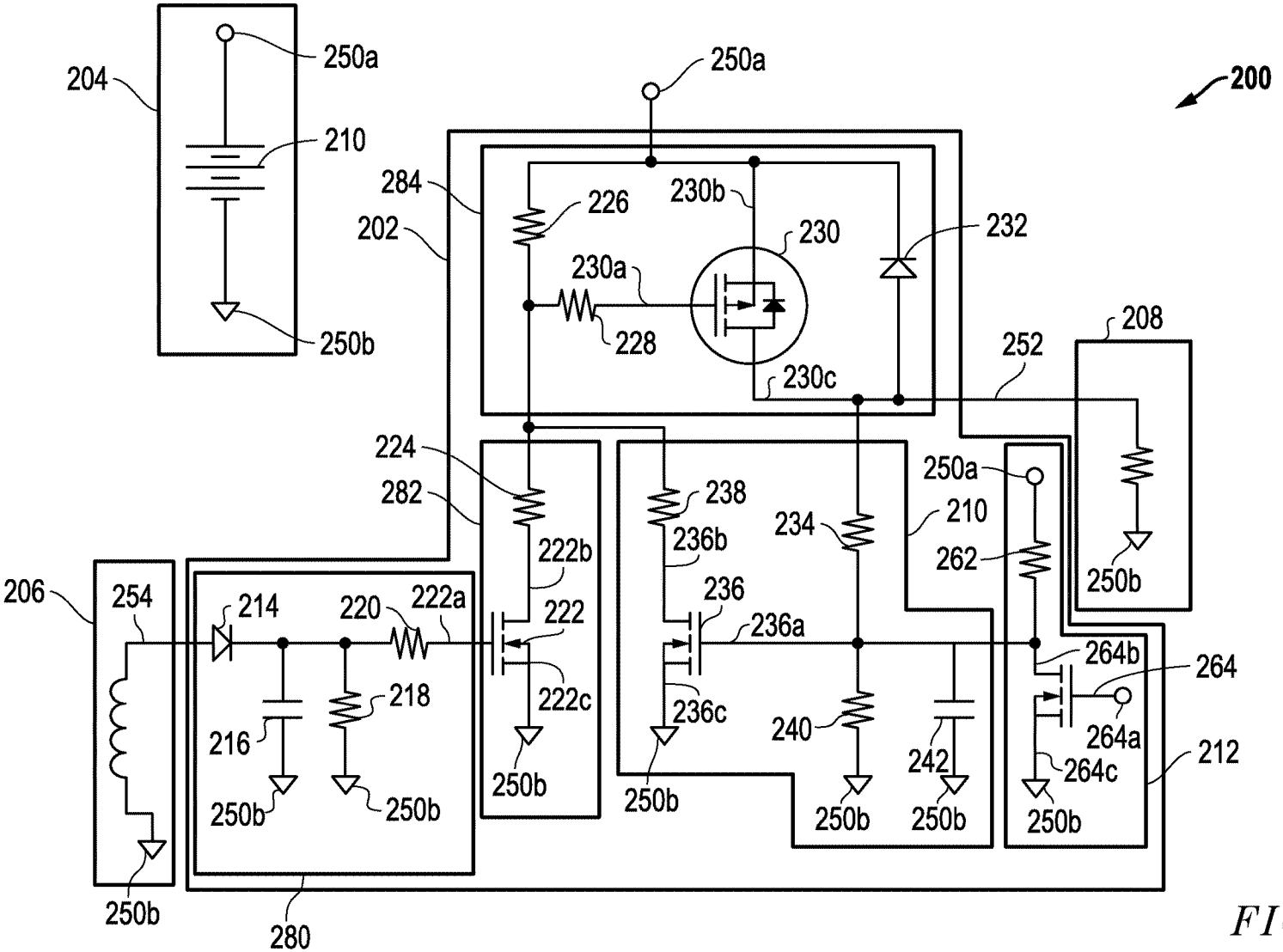
FIG. 3 is a schematic view of an embodiment of an electronic circuit comprising a switching system.

Referring to FIG. 3, an embodiment of the receiver system 200 is illustrated. In such an embodiment, the switching system 202 is configured to selectively transition from a first state where the switching system 202 is an incomplete circuit and a route of electrical current between the power supply 204 and the electrical load 208 is disallowed (e.g., an inactive state) to a second state where the switching system 202 is a complete circuit and a route of electrical current between the power supply 204 and the electrical load 208 is allowed to provide electrical power from the power supply 204 to the electrical load 208 (e.g., an active state) upon receiving and/or experiencing a triggering signal, as will be disclosed herein. Additionally, in the inactive state the well tool is configured to not consume power. For example, in the embodiment of FIG. 3, the switching system 202 comprises a plurality of components coupled to the power supply 204 and is configured to provide power to the electrical load when so-configured. For example, in such an embodiment, the power supply 204 may comprise a battery 210 having a positive voltage terminal 250*a* and the electrical ground 250*b*.

In an embodiment, the switching system 202 comprises a rectifier portion 280, a triggering portion 282, and a power switching portion 284. For example, the rectifier portion 280 may be configured to convert a triggering signal (e.g., an alternating current (AC) signal) received by the receiving unit 206 to a rectified signal (e.g., a direct current (DC) signal) to be applied to the triggering portion 282. In such an embodiment, the rectifier portion 280 may comprise a diode 214 electrically coupled (e.g., via an anode terminal) to the receiving unit 206 and electrically coupled (e.g., via a cathode terminal) to a capacitor 216 and a resistor 218 connected in parallel with the electrical ground 250*b* and a resistor 220 electrically coupled to the triggering portion 282 (e.g., via an input terminal).

In an embodiment, the triggering portion 282 may comprise an electronic switch 222 (e.g., a transistor, a mechanical relay, a silicon-controlled rectifier, etc.) configured to selectively allow a route of electrical current communication between a first terminal (e.g., a first switch terminal 222*b*) and a second terminal (e.g., a second switch terminal 222*c*) upon experiencing a voltage or current applied to an input terminal (e.g., an input terminal 222*a*), for example, to activate the power switching portion 284, as will be disclosed herein. For example, in the embodiment of FIG. 3, the electronic switch 222 is a transistor (e.g., a n-channel metal-oxide-semiconductor field effect transistor (NMOSFET)). The electronic switch 222 may be configured to selectively provide an electrical current path between the positive voltage terminal 250*a* and the electrical ground 250*b*, for example, via resistors 226 and 224, the first terminal 222*b*, and the second terminal 222*c* upon experiencing a voltage (e.g., a voltage greater than the threshold voltage of the NMOSFET) applied to the input terminal 222*a*, for example, via the rectifier portion 280. Additionally, in the embodiment of FIG. 3, the triggering portion 282 may be configured to activate the power switching portion 284 (e.g., thereby providing a route of electrical current flow from the power supply 204 to the electrical load 208) until the voltage applied to the input terminal 222*a* falls below a threshold voltage required to activate the electronic switch 222.

In an embodiment, the power switching portion 284 may comprise a second electronic switch 230 (e.g., a transistor, a mechanical relay, etc.) configured to provide power from the power supply 204 (e.g., the positive voltage terminal 250*a*) to the electrical load 208 (e.g., a packer, a sensor, an actuator, etc.). For example, in the embodiment of FIG. 3, the second electronic switch 230 is a transistor (e.g., a p-channel metal-oxide-semiconductor field effect transistor (PMOSFET)). The second electronic switch 230 may be configured to provide an electrical current path between the power supply 204 and the electrical load 208 (e.g., via a first terminal 230*b* and a second terminal 230*c*) upon experiencing a voltage drop at an input terminal 230*a*, for example, a voltage drop caused by the activation of the triggering portion 282 and/or a feedback portion 210, as will be disclosed herein. In an embodiment, the input terminal 230*a* may be electrically coupled to the triggering portion 282 via a resistor 228, for example, at an electrical node or junction between the resistor 224 and the resistor 226. In such an embodiment, the first terminal 230*b* is electrically coupled to the positive voltage terminal 250*a* of the power supply 204 and the second terminal 230 is electrically coupled to the electrical load 208. Further, a diode 232 may be electrically coupled across the first terminal 230*b* and the second terminal 230*c* of the electronic switch 230 and may be configured to be forward biased in the direction from the second terminal 230*c* to the first terminal 230*b*.

Additionally, the switching system 202 may further comprise a feedback portion 210. In an embodiment, the feedback portion 210 may be configured to keep the power switching portion 284 active (e.g., providing power from the power supply 204 to the electrical load 208), for example, following the deactivation of the triggering portion. For example, in the embodiment of FIG. 3, the feedback portion comprises a third electronic switch 236 (e.g., a NMOSFET transistor). In such an embodiment, an input terminal 236*a* of the third electronic switch 236 is electrically coupled to power switching portion (e.g., the second terminal 230*c* of the second electronic switch 230). Additionally, the third electronic switch 236 may be configured to provide an electrical current path between the positive voltage terminal 250*a* and the electrical ground 250*b*, for example, via the resistor 226, a resistor 238, a first terminal 236*b*, and a second terminal 236*c* upon experiencing a voltage (e.g., a voltage greater than the threshold voltage of the NMOSFET) applied to the input terminal 236*a*, for example, via the power switching portion 284. Further, the third electronic switch 236 may be electrically coupled to the power switching portion 284, for example, the input terminal 230*a* of the second electronic switch 230 via the resistor 228, the resistor 238, and the first terminal 236*b*. Additionally in the embodiment of FIG. 3, the feedback portion 210 comprises a resistor-capacitor (RC) circuit, for example, an RC circuit comprising a resistor 240 and a capacitor 242 in parallel and electrically coupled to the input terminal 236*a* of the third electronic switch 236 and the electrical ground 250*b*. In an embodiment, the RC circuit is configured such that an electrical current charges one or more capacitors (e.g., the capacitor 242) and, thereby generates and/or applies a voltage signal to the input terminal 236*a* of the third electronic switch 236. In such an embodiment, the one or more capacitors may charge (e.g., accumulate voltage) and/or decay (e.g., exit and/or leak voltage) over time at a rate proportional to an RC time constant established by the resistance and the capacitance of the one or more resistors and the one or more capacitors of the RC circuit. For example, in an embodiment, the RC circuit may be configured such that the charge and/or voltage of the one or more capacitors of the RC circuit accumulates over a suitable duration of time to allow power transmission from the power supply 204 to the electrical load 208, as will be disclosed herein. For example, suitable durations of time may be about 10 millisecond (ms), alternatively, about 25 ms, alternatively, about 50 ms, alternatively, about 100 ms, alternatively, about 200 ms, alternatively, about 500 ms, alternatively, about 1 second (s), alternatively, about 2 s, alternatively, about 5 s, alternatively, about 10 s, alternatively, about 30 s, alternatively, about 10 minute, alternatively, about 30 minutes, alternatively, about 60 minutes, alternatively, about 120 minutes, alternatively, any other suitable duration of time, as would be appreciated by one of ordinary skill in the art upon viewing this disclosure.

Additionally, the switching system 202 may further comprise a power disconnection portion 212. In an embodiment, the power disconnection portion 212 may be configured to deactivate the feedback portion 210 and thereby suspend the power transmission between the power supply 204 and the electrical load 208. Additionally, the power disconnection portion 212 comprises a fourth electronic switch 264 (e.g., a NMOSFET transistor). In such an embodiment, an input terminal 264*a* of the fourth electronic switch 264 is electrically coupled to an external voltage trigger (e.g., an input-output (I/O) port of a processor or controller). Additionally, the fourth electronic switch 264 may be configured to provide an electrical current path between the positive voltage terminal 250*a* and the electrical ground 250*b*, for example, via a resistor 262, a first terminal 264*b*, and a second terminal 264*c* upon experiencing a voltage (e.g., a voltage greater than the threshold voltage of the NMOSFET) applied to the input terminal 264*a*, for example, via an I/O port of a processor or controller. Further, the fourth electronic switch 264 may be electrically coupled to the feedback portion 210. For example, the input terminal 236*a* of the third electronic switch 236 may be electrically coupled to the power disconnection portion 212 via the first terminal 264*b* of the fourth electronic switch 264. In an alternative embodiment, the input terminal 264*a* of the fourth electronic switch 264 is electrically coupled to the rectifier portion 280 and configured such that a rectified signal generated by the rectifier portion 280 (e.g., in response to a triggering signal) may be applied to the fourth electronic switch 264 to activate the fourth electronic switch 264. In an additional or alternative embodiment, the input terminal 264*a* of the fourth electronic switch 264 is electrically coupled to the rectifier portion 280 via a latching system. For example, the latching system may be configured to toggle in response to the rectified signal generated by the rectifier portion 280. In such an embodiment, the latching system may be configured to not activate the power disconnection portion 212 in response to a first rectified signal (e.g., in response to a first triggering signal) and to activate the power disconnection portion 212 in response to a second rectified signal (e.g., in response to a second triggering signal). As such, the power disconnection portion 212 will deactivate the feedback portion 210 in response to the second rectified signal. Any suitable latching system may be employed as would be appreciate by one of ordinary skill in the art upon viewing this disclosure.

Figure 4:
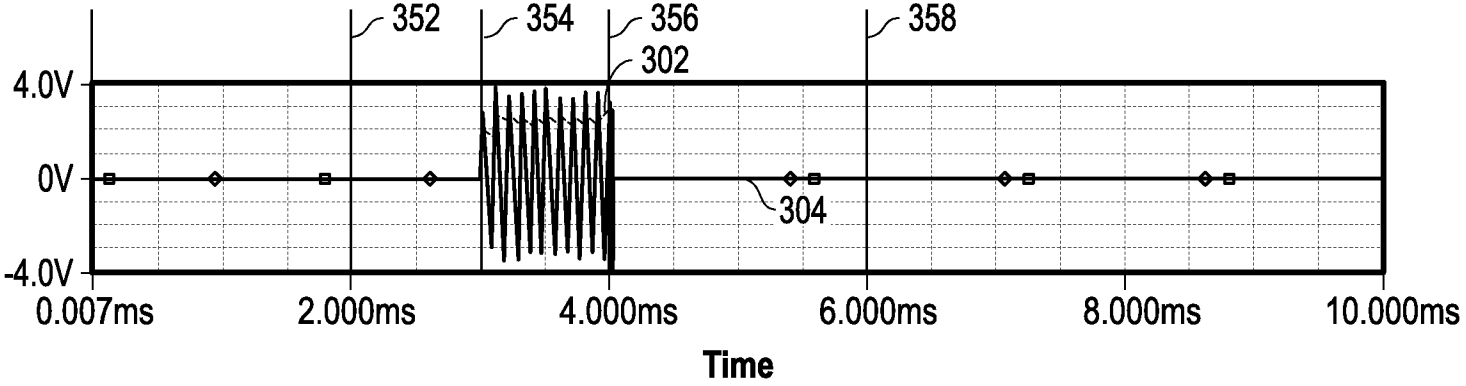
FIG. 4 is an embodiment of a plot of a diode voltage and a rectified diode voltage with respect to time measured at the input of a switching system.
Figure 5:
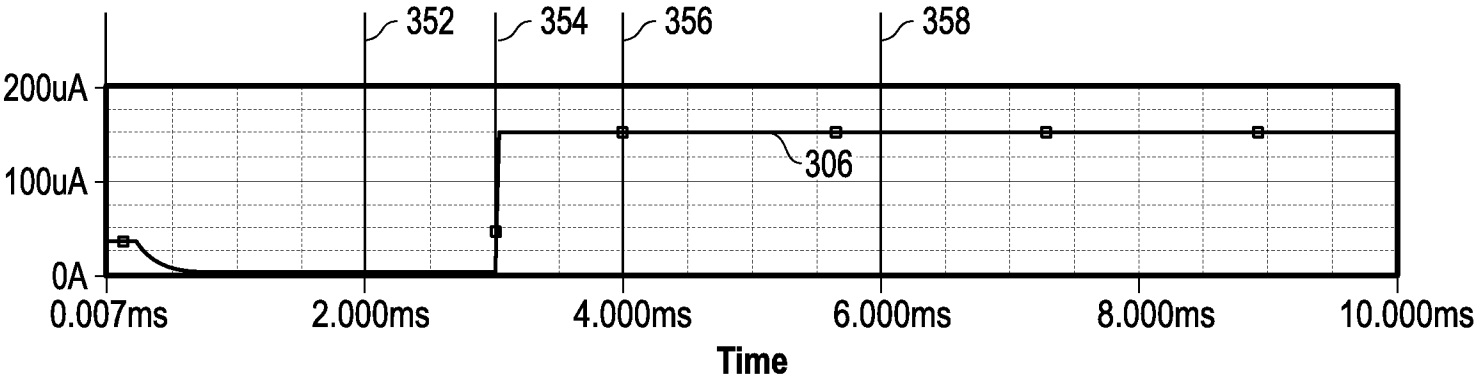
FIG. 5 is an embodiment of a plot of current flow measured over time through an electronic switch of a switching system.

In the embodiment of FIG. 3, the receiver system 200 is configured to remain in the inactive state such that the switching system 202 is an incomplete circuit until sensing and/or receiving a triggering signal to induce an electrical response and thereby completing the circuit. For example, the one or more components of the switching system 202 are configured to remain in a steady state and may be configured to draw substantially no power, as shown at time 352 in FIGS. 4-7. In an embodiment, the receiving system 200 is configured such that in response to the receiving unit 206 experiencing a triggering signal (e.g., a triggering signal 304 as shown between time 354 and time 356 in FIG. 4) an electrical response is induced causing the rectifier portion of the switching system 202 will generate and/or store a rectified signal (e.g., a rectified signal 302 as shown between time 354 and time 356 in FIG. 4). The rectified signal may be applied to the electronic switch 222 and may be sufficient to activate the electronic switch 222 and thereby provide a route of electrical current communication across the electronic switch 222, for example, between the first terminal 222*b* and the second terminal 222*c* of the electronic switch 222. In such an embodiment, activating the electronic switch 222 may configure the switching system 202 to allow a current to flow (e.g., a current 306 as shown from time 354 onward in FIG. 5) between the positive voltage terminal 250*a* and the electrical ground 250*b* via the resistor 226, the resistor 224, and the electronic switch 222. As such, the switching system 202 is configured such that inducing a current (e.g., via the electronic switch 222), activates the second electronic switch 230, for example, in response to a voltage drop caused by the induced current and experienced by the input terminal 230*a*. In an embodiment, activating the second electronic switch 230 configures the switching system 202 to form a complete circuit and to allow a current to flow from the positive voltage terminal 250*a* to the electrical load 208 via the second electronic switch 230 and, thereby provides power to the electrical load 208. In the embodiment of FIG. 3, the electrical load 208 is a resistive load and is configured such that providing a current to the electrical load 208 induces a voltage across the electrical load 208 (e.g., as shown as a voltage signal 310 in FIG. 7). Alternatively, the electrical load 208 may be any other suitable type electrical load as would be appreciated by one of ordinary skill in the art upon viewing this disclosure, as will be disclosed herein.

Figure 6:
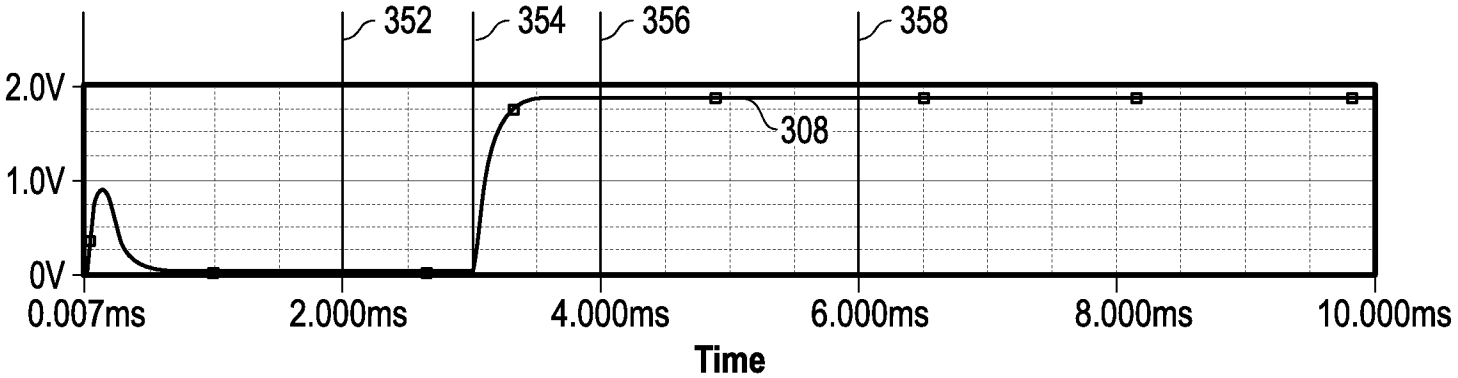
FIG. 6 is an embodiment of a plot of an electronic switch input voltage with respect to time of a switching system.
Figure 7:
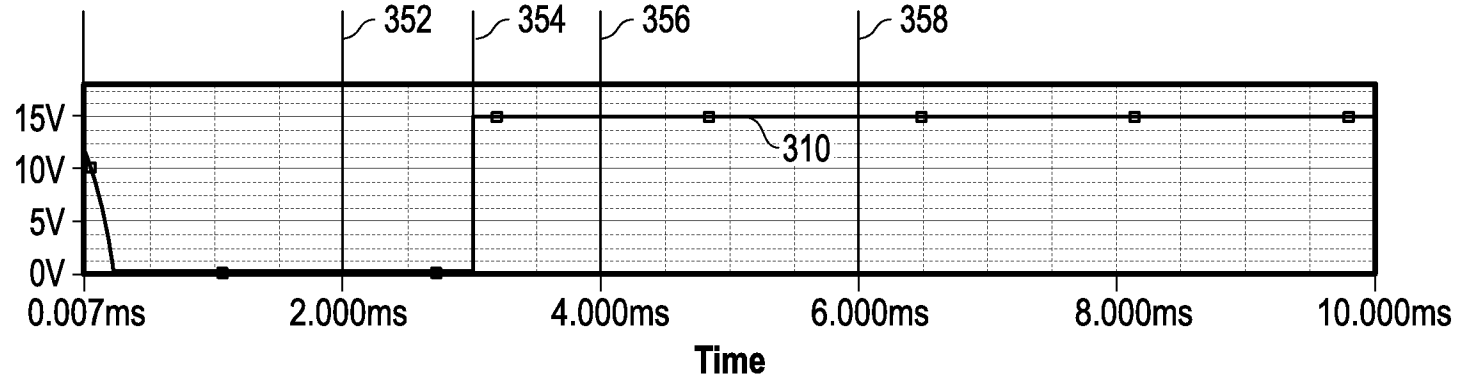
FIG. 7 is an embodiment of a plot of a load voltage measured with respect to time of an electrical load.

Additionally, where the switching system 202 comprises a feedback portion 210, activating the second electronic switch 230 configures the switching system 202 to allow a current flow to the RC circuit of the feedback portion 210 which may induce a voltage (e.g., a voltage 308 as shown in FIG. 6) sufficient to activate the third electronic switch 236 and thereby provide a route of electrical current communication across the third electronic switch 236, for example, between the first terminal 236*b* and the second terminal 236*c* of the third electronic switch 236. In such an embodiment, activating the third electronic switch 236 configures the switching system 202 to generate a current flow between the positive voltage terminal 250*a* and the electrical ground 250*b* via the resistor 226, the resistor 238, and the third electronic switch 236. As such, the switching system 202 is configured such that inducing a current (e.g., via the third electronic switch 236), retains the second electronic switch 230 in the activated state, for example, as shown from time 358 onward in FIGS. 4-7.

In an additional embodiment, where the switching system 202 comprises a power disconnection portion 212, applying a voltage (e.g., via an I/O port of a processor or controller) to the input terminal 264*a* of the fourth electrical switch 264 configures the switching system 202 to deactivate the feedback portion 210 and thereby suspend the power transmission between the power supply 204 and the electrical load 208. For example, activating the fourth electronic switch 264 causes an electrical current path between the input terminal 236*a* of the third electronic switch 236 and the electrical ground 250*b* via the first terminal 264*b* and the second terminal 264*c* of the fourth electronic switch 264. As such, the voltage applied to input terminal 236*a* of the third electronic switch 236 may fall below voltage level sufficient to activate the third electronic switch 236 (e.g., below the threshold voltage of the NMOSFET) and thereby deactivates the third electronic switch 236 and the feedback portion 210.

In an embodiment, the electrical load (e.g., the electrical load 208) may be a resistive load, a capacitive load, and/or an inductive load. For example, the electrical load 208 may comprise one or more electronically activatable tool or devices. As such, the electrical load may be configured to receive power from the power supply (e.g., power supply 204) via the switching system 202, when so-configured. In an embodiment, the electrical load 208 may comprise a transducer, a microprocessor, an electronic circuit, an actuator, a wireless telemetry system, a fluid sampler, a detonator, a motor, a transmitter system, a receiver system, a transceiver, any other suitable passive or active electronically activatable tool or devices, or combinations thereof.

Figure 8:
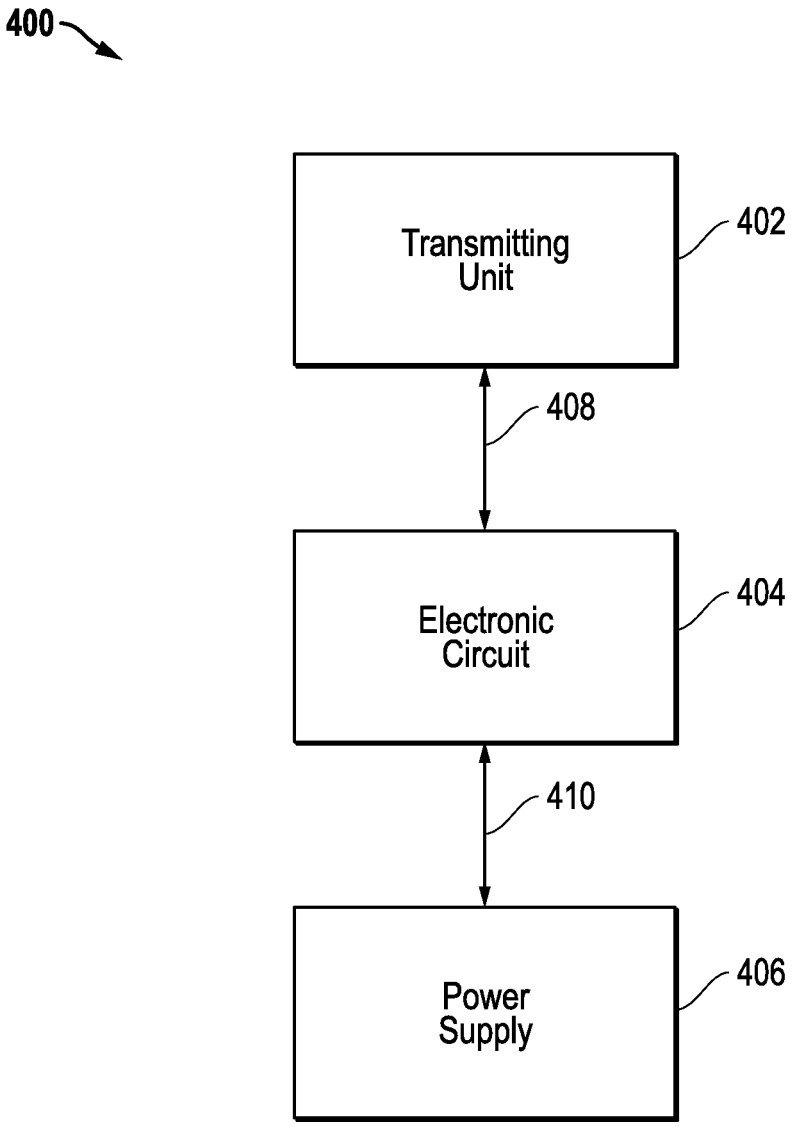
FIG. 8 is a block diagram view of an embodiment of a transmitter system.

In an additional embodiment, the transmitting well tool may further comprise a transmitter system 400 configured to transmit a triggering signal to one or more other well tools. In the embodiment of FIG. 8, the transmitter system 400 may generally comprise various functional units including, but not limited to a power supply 406, a transmitting unit 402, and an electronic circuit 404. For example, in the embodiment of FIG. 8, the electronic circuit 404 may be in electrical signal communication with the transmitting unit 402 (e.g., via electrical connection 408) and with the power supply 406 (e.g., via electrical connection 410).

In an alternative embodiment, the well tool may comprise various combinations of such functional unit (e.g., a power supply, an antenna, and an electronic circuit, etc.). While FIG. 8 illustrates a particular embodiment of a transmission system comprising a particular configuration of functional units, upon viewing this disclosure one of ordinary skill in the art will appreciate that a transmission system as will be disclosed herein may be similarly employed with alternative configurations of functional units.

In an embodiment, the transmitting unit 402 may be generally configured to transmit a triggering signal. For example, the transmitting unit 402 may be configured to receive an electronic signal and to output a suitable triggering signal (e.g., an electrical signal sufficient to activate the switching system 202).

In an embodiment, the transmitting unit 402 may comprise one or more antennas. The antennas may be configured to transmit and/or receive a triggering signal, similarly to what has been previously disclosed with respect to the receiving unit 206. In an additional or alternative embodiment, the transmitting unit 402 may comprise one or more energy sources (e.g., an electromagnet, a light source, etc.). As such, the energy source may be in electrical signal communication with the electronic circuit 404 and may be employed to generate and/or transmit a triggering signal (e.g., an acoustic signal, an optical signal, a magnetic signal, etc.).

In an embodiment, the power supply (e.g., the power supply 406) may supply power to the electronic circuit 404, and/or any other functional units of the transmitting well tool, similarly to what has been previously disclosed.

Figure 9:
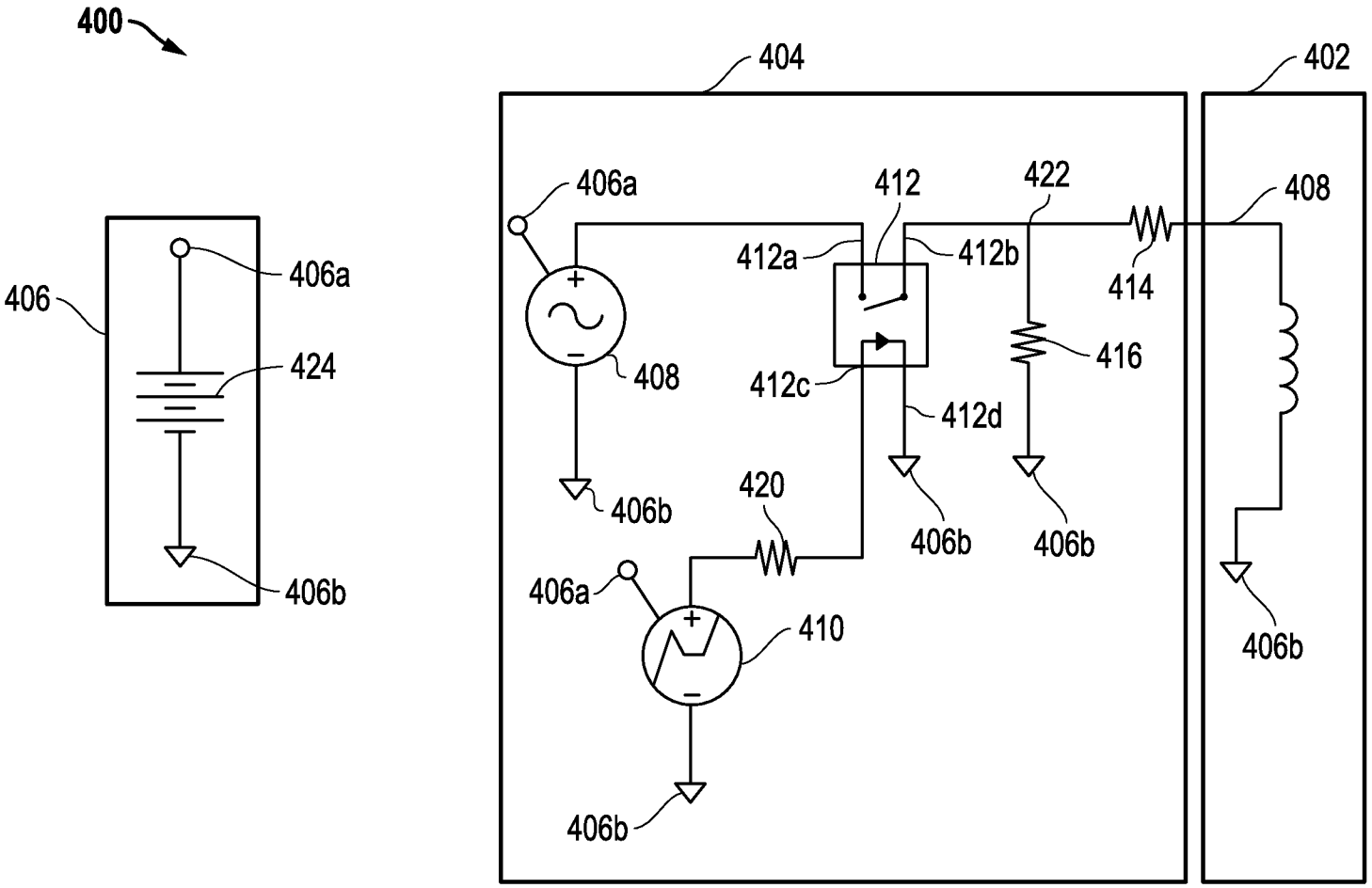
FIG. 9 is a schematic view of an embodiment of a transmitter system.

Referring to FIG. 9, an embodiment of the transmitter system 400 is illustrated. In such an embodiment, the electronic circuit 404 is configured to generate and transmit a triggering signal. For example, the electronic circuit 404 may comprise a pulsing oscillator circuit configured to periodically generate a triggering signal. In an embodiment, the electronic circuit 404 comprises an electronic switch 412 (e.g., a mechanical relay, a transistor, etc.). In such an embodiment, the electronic switch 412 may be configured to provide a route of electrical signal communication between a first contact 412*a* (e.g., a normally open input) and a second contact 412*b* (e.g., a common input) in response to the application of an electrical voltage or current across a third contact 412*c* and a fourth contact 412*d*, as will be disclosed herein. For example, the third contact 412*c* and the fourth contact 412*d* may be terminal contacts of an electronic gate, a relay coil, a diode, etc. In an embodiment, the electronic circuit 404 comprises an oscillator 408 in electrical signal communication with the first contact 412*a* of the electronic switch 412. In such an embodiment, the oscillator 408 may be configured to generate a sinusoidal signal, for example, a sinusoidal waveform having a frequency of about 10 kHz. Additionally, the electronic circuit 404 comprises a pulse generator 410 in electrical signal communication with the third contact 412*c* of the electronic switch 412 via a resistor 420. In such an embodiment, the pulse generator 410 may be configured to periodically generate a pulse signal (e.g., a logical voltage high) for a predetermined duration of time, for example, a 100 Hz signal with a pulse having a pulse width of about 1 millisecond (mS). Further, the electronic switch 412 is electrically connected to an electrical ground 406*b* via the fourth contact 412*d*. Additionally, the electronic switch 412 is in electrical signal communication with a resistor network, for example, via the second contact 412*b* electrically connected to an electrical node 422. For example, the resistor network may comprise a resistor 416 coupled between the electrical node 422 and the electrical ground 406*b* and a resistor 414 coupled between the electrical node 422 and the transmitting unit 402. Further, one or more components of the electronic circuit 404 (e.g., the oscillator 408, the pulse generator 410, etc.) are electrically coupled to the power supply 406. For example, in such an embodiment, the power supply 406 may comprise a battery 424 having a positive voltage terminal 406*a* and the electrical ground 406*b* and may provide power to the oscillator 408 and/or the pulse generator 410.

In the embodiment of FIG. 9, the transmitter system 400 is configured such that applying a pulse signal to the third contact 412*c* of the electronic switch 412 induces a voltage and/or current between the third contact 412*c* and the fourth contact 412*d* of the electronic switch 412 and, thereby activates the electronic switch 412 to provide a route of electrical signal communication between the first contact 412*a* and the second contact 412*b*. As such, a triggering signal (e.g., a sinusoidal signal) is communicated from the oscillator 408 to the transmitting unit 402 via the electronic switch 412 and the resistor network upon the application of a pulse signal from the pulse generator 410 across the electronic switch 412. As such, the transmitting unit 402 is configured to transmit the triggering signal (e.g., the sinusoidal signal).

In an embodiment, the receiving and/or transmitting well tool may further comprise a processor (e.g., electrically coupled to the switching system 202 or the electronic circuit 404), which may be referred to as a central processing unit (CPU), may be configured to control one or more functional units of the receiving and/or transmitting well tool and/or to control data flow through the well tool. For example, the processor may be configured to communicate one or more electrical signals (e.g., data packets, control signals, etc.) with one or more functional units of the well tool (e.g., a switching system, a power supply, an antenna, an electronic circuit, and an electrical load, etc.) and/or to perform one or more processes (e.g., filtering, logical operations, signal processing, counting, etc.). For example, the processor may be configured to apply a voltage signal (e.g., via an I/O port) to the power disconnection portion 212 of the switching system 202, for example, following a predetermined duration of time. In such an embodiment, one or more of the processes may be performed in software, hardware, or a combination of software and hardware. In an embodiment, the processor may be implemented as one or more CPU chips, cores (e.g., a multi-core processor), digital signal processor (DSP), an application specific integrated circuit (ASIC), and/or any other suitable type and/or configuration as would be appreciated by one of ordinary skill in the arts upon viewing this disclosure.

In an embodiment, one or more well tools may comprise a receiver system 200 and/or a transmitter system 400 (e.g., disposed within an interior portion of the well tool) and each having a suitable configuration, as will be disclosed herein, may be utilized or otherwise deployed within an operational environment such as previously disclosed. For example, each of the one or more well tools.

In an embodiment, a well tool may be characterized as stationary. For example, in an embodiment, such a stationary well tool or a portion thereof may be in a relatively fixed position, for example, a fixed position with respect to a tubular string disposed within a wellbore. For example, in an embodiment a well tool may be configured for incorporation within and/or attachment to a tubular string (e.g., a drill string, a work string, a coiled tubing string, a jointed tubing string, or the like). In an additional or alternative embodiment, a well tool may comprise a collar or joint incorporated within a string of segmented pipe and/or a casing string.

Additionally, in an embodiment, the well tool may comprise and/or be configured as an actuatable flow assembly (AFA). In such an embodiment, the AFA may generally comprise a housing and one or more sleeves movably (e.g., slidably) positioned within the housing. For example, the one or more sleeves may be movable from a position in which the sleeves and housing cooperatively allow a route of fluid communication to a position in which the sleeves and housing cooperatively disallow a route of fluid communication, or vice versa. For example, in an embodiment, the one or more sleeves may be movable (e.g., slidable) relative to the housing so as to obstruct or unobstruct one or more flow ports extending between an axial flowbore of the AFA and an exterior thereof. In various embodiments, a node comprising an AFA may be configured for use in a stimulation operation (such as a fracturing, perforating, or hydrojetting operation, an acidizing operation), for use in a drilling operation, for use in a completion operation (such as a cementing operation or fluid loss control operation), for use during production of formation fluids, or combinations thereof. Suitable examples of such an AFA are disclosed in U.S. patent application Ser. No. 13/781,093 to Walton et al. filed on Feb. 28, 2013 and U.S. patent application Ser. No. 13/828,824 filed on Mar. 14, 2013, each of which is incorporated herein by reference in its entirety.

In another embodiment, the well tool may comprise and/or be configured as an actuatable packer. In such an embodiment, the actuatable packer may generally comprise a packer mandrel and one or more packer elements that exhibit radial expansion upon being longitudinally compressed. The actuatable packer may be configured such that, upon actuation, the actuatable pack is caused to longitudinally compress the one or more packer elements, thereby causing the packer elements to radially expand into sealing contact with the wellbore walls or with an inner bore surface of a tubular string in which the actuatable packer is disposed. Suitable examples of such an actuatable packer are disclosed in U.S. patent application Ser. No. 13/660,678 to Helms et al. filed on Oct. 25, 2012, which is incorporated herein by reference in its entirety.

In another embodiment, the well tool may comprise and/or be configured as an actuatable valve assembly (AVA). In such an embodiment, the AVA may generally comprise a housing generally defining an axial flowbore therethrough and an acuatable valve. The actuatable valve may be positioned within the housing (e.g., within the axial flowbore) and may be transitionable from a first configuration in which the actuatable valve allows fluid communication via the axial flowbore in at least one direction to a second configuration in which the actuatable valve does not allow fluid communication via the flowbore in that direction, or vice versa. Suitable configurations of such an actuatable valve include a flapper valve and a ball valve. In an embodiment, the actuatable valve may be transitioned from the first configuration to the second configuration, or vice-verse, via the movement of a sliding sleeve also positioned within the housing, for example, which may be moved or allowed to move upon the actuation of an actuator. Suitable examples of such an AVA are disclosed in International Application No. PCT/US 13/27674 filed Feb. 25, 2013 and International Application No. PCT/US 13/27666 filed Feb. 25, 2013.

Alternatively, a well tool may be characterized as transitory. For example, in an embodiment, such a transitory well tool may be mobile and/or positionable, for example, a ball or dart configured to be introduced into the wellbore, communicated (e.g., pumped/flowed) within a wellbore, removed from the wellbore, or any combination thereof. In an embodiment, a transitory well tool may be a flowable or pumpable component, a disposable member, a ball, a dart, a wireline or work string member, or the like and may be configured to be communicated through at least a portion of the wellbore and/or a tubular disposed within the wellbore along with a fluid being communicated therethrough. For example, such a well tool may be communicated downwardly through a wellbore (e.g., while a fluid is forward-circulated into the wellbore). Additionally or alternatively, such a well tool may be communicated upwardly through a wellbore (e.g., while a fluid is reverse-circulated out of the wellbore or along with formation fluids flowing out of the wellbore).

In an embodiment, where the transitory well tool is a disposable member (e.g., a ball), the transitory well tool may be formed of a sealed (e.g., hermetically sealed) assembly. As such, the transitory well tool may be configured such that access to the interior, a receiver system 200, and/or transmitter system 400 is no longer provided and/or required. Such a configuration may allow the transitory well tool to be formed having minimal interior air space and, thereby increasing the structural strength of the transitory well tool. For example, such a transitory well tool may be configured to provide an increase in pressure holding capability. Additionally, such a transitory well tool may reduce and/or prevent leakage pathways from the exterior to an interior portion of the transitory well tool and thereby reduces and/or prevents potential corruption of any electronics (e.g., the receiver system 200, the transmitter system 400, etc.).

In an embodiment, one or more receiving well tools and transmitting well tools employing a receiver system 200 and/or a transmitter system 400 and having, for example, a configuration and/or functionality as disclosed herein, or a combination of such configurations and functionalities, may be employed in a wellbore servicing system and/or a wellbore servicing method, as will be disclosed.

Figure 10:
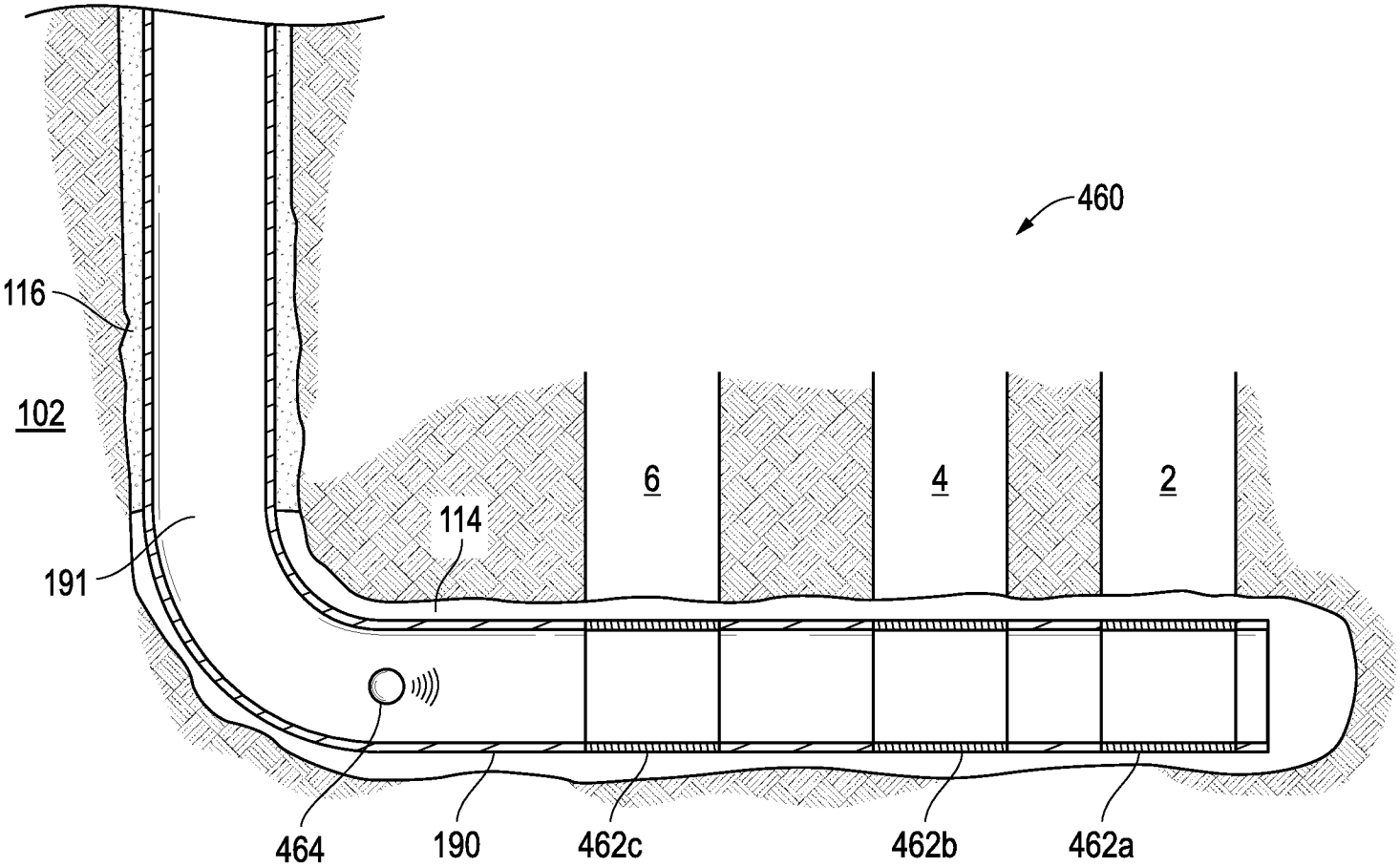
FIGS. 10 through 12 are representative partially cross-sectional views of embodiments of wellbore servicing systems.

Referring to FIG. 10, an embodiment of a wellbore servicing system having at least one receiving well tool and a transmitting well tool communicating via a triggering signal is illustrated. In the embodiment of FIG. 10 the wellbore servicing system comprises an embodiment of a wellbore servicing system 460, for example, a system generally configured to perform one or more wellbore servicing operations, for example, the stimulation of one or more zones of a subterranean formation, for example, a fracturing, perforating, hydrojetting, acidizing, a system generally configured to perform at least a portion of a production operation, for example, the production of one or more fluids from a subterranean formation and/or one or more zones thereof, or a like system. Additionally or alternatively, the wellbore servicing system 460 may be configured to log/measure data from within a wellbore or any other suitable wellbore servicing operation as will be appreciated by one of ordinary skill in the art upon viewing this disclosure.

In the embodiment of FIG. 10, the wellbore servicing system 460 comprises one or more stationary receiving well tools 462 (particularly, stationary receiving well tools 462*a*, 462*b*, and 462*c*, for example, each comprising a receiver system, as disclosed with respect to FIG. 3) disposed within the wellbore 114. While the embodiment of FIG. 10 illustrates an embodiment in which there are three stationary receiving well tools 462, in another embodiment any suitable number of stationary receiving well tools 462 may be employed. In the embodiment of FIG. 10, each of the stationary receiving well tools 462 may be generally configured for the performance of a subterranean formation stimulation treatment, for example, via the selective delivery of a wellbore servicing fluid into the formation. For example, each of the stationary receiving well tools 462 may comprise an AFA as disclosed herein, such that each of the stationary receiving well tools 462 may be selectively caused to allow, disallow, or alter a route of fluid communication between the wellbore (e.g., between the axial flowbore 191 of the casing string 190) and one or more subterranean formation zones, such as formation zones 2, 4, and 6. The stationary receiving well tools 462 may be configured to deliver such a wellbore servicing fluid at a suitable rate and/or pressure. In an alternative embodiment, one or more of the stationary receiving well tools 462 may be configured to measure and/or to log data from within the wellbore 114. For example, one or more of the stationary receiving well tool 462 may comprise one or more transducers and/or a memory device. Alternatively, one or more of the stationary receiving well tools 462 may be configured to perform any other suitable wellbore servicing operation as will be appreciated by one of ordinary skill in the art upon viewing this disclosure.

Also in the embodiment of FIG. 10, the wellbore servicing system 460 further comprises a transitory transmitting well tool 464 (e.g., comprising a transmitter system, as disclosed with respect to FIG. 9). In the embodiment of FIG. 10, the transitory transmitting well tool 464 is generally configured to transmit one or more triggering signals to one or more of the stationary receiving well tools 462 effective to activate the switching system 202 of one or more of the stationary receiving well tools 462 to output a given response, for example, to actuate the stationary receiving well tool 462. In the embodiment of FIG. 10, the transitory transmitting well tool 464 comprises a ball, for example, such that the transitory transmitting well tool 464 may be communicated through the casing string 190. Alternatively, the transitory transmitting well tool 464 may comprise any suitable type or configuration, for example, a work string member.

In an embodiment, a wellbore servicing system such as the wellbore servicing system 460 disclosed with respect to FIG. 10 may be employed in the performance of a wellbore servicing operation, for example, a wellbore stimulation operation, such as a fracturing operation, a perforating operation, a hydrojetting operation, an acidization operation, or combinations thereof. In an alternative embodiment, the wellbore servicing system 460 may be employed to measure and/or to log data, for example, for data collection purposes. Alternatively, the wellbore servicing system 460 may be employed to perform any other suitable wellbore servicing operation as will be appreciated by one of ordinary skill in the art upon viewing this disclosure. In an embodiment, such a wellbore stimulation operation may generally comprise the steps of positioning one or more stationary receiving well tools within a wellbore, communicating a transitory transmitting well tool transmitting a triggering signal through the wellbore, sensing the triggering signal to activate a switching system of one or more of the stationary receiving well tools, and optionally, repeating the process of activating a switching system of one or more additional stationary receiving well tools with respect to one or more additional transitory well tools.

Referring again to FIG. 10, in an embodiment, one or more stationary receiving well tools 462 may be positioned within a wellbore, such as wellbore 114. For example, in the embodiment of FIG. 10 where the stationary receiving well tools 462 are incorporated within the casing string 190, the stationary receiving well tools 462 may be run into the wellbore 114 (e.g., positioned at a desired location within the wellbore 114) along with the casing string 190. Additionally, during the positioning of the stationary receiving well tools 462, the stationary receiving well tools 462 are in the inactive state.

In an embodiment, a transitory transmitting well tool 464 may be introduced in the wellbore 114 (e.g., into the casing string 190) and communicated downwardly through the wellbore 114. For example, in an embodiment, the transitory transmitting well tool 464 may be communicated downwardly through the wellbore 114, for example, via the movement of a fluid into the wellbore 114 (e.g., the forward-circulation of a fluid). As the transitory transmitting well tool 464 is communicated through the wellbore 114, the transitory transmitting well tool 464 comes into signal communication with one or more stationary receiving well tools 462, for example, one or more of the stationary receiving well tools 462*a*, 462*b*, and 462*c*, respectively. In an embodiment, as the transitory transmitting well tool 464 comes into signal communication with each of the stationary receiving well tools 462, the transitory transmitting well tool 464 may transmit a triggering signal to the stationary receiving well tools 462.

In an embodiment, the triggering signal may be sufficient to activate one or more stationary receiving well tools 462. For example, one or more switching systems 202 of the stationary receiving well tools 462 may transition from the inactive state to the active state in response to the triggering signal. In such an embodiment, upon activating a stationary receiving well tool 462, the switching system 202 may provide power to the electrical load 208 coupled with the stationary receiving well tool 462. For example, the electrical load 208 may comprise an electronic actuator which actuates (e.g., from a closed position to an open position or vice-versa) in response to receiving power from the switching system 202. As such, upon actuation of the electronic actuator, the stationary receiving tool 462 may transition from a first configuration to a second configuration, for example, via the transitioning one or more components (e.g., a valve, a sleeve, a packer element, etc.) of the stationary receiving well tool 462. Alternatively, the electrical load 208 may comprise a transducer and/or a microcontroller which measures and/or logs wellbore data in response to receiving power from the switching system 202. Alternatively, the electrical load 208 may comprise a transmitting system (e.g., transmitting system 400) and may begin communicating a signal (e.g., a triggering signal, a near field communication (NFC) signal, a radio frequency identification (RFID) signal, etc.) in response to providing power to the electrical load 208. Alternatively, the stationary receiving well tool 462 may employ any suitable electrical load 208 as would be appreciated by one of ordinary skill in the art upon viewing this disclosure.

In an additional or alternative embodiment, the switching system 202 of one or more of the stationary well tools 462 is configured such that the stationary receiving well tool 462 will remain in the active state (e.g., providing power to the electrical load 208) for a predetermined duration of time. In such an embodiment, following the predetermined duration of time, the switching system 202 may transition from the active state to the inactive state and, thereby no longer provide power to the electrical load 208. For example, the switching system 202 may be coupled to a processor and the processor may apply a voltage signal to the power disconnection portion 212 of the switching system 202 following a predetermined duration of time.

In an additional or alternative embodiment, the switching system 202 of one or more of the stationary receiving well tools 462 is coupled to a processor and is configured to increment or decrement a counter (e.g., a hardware or software counter) upon activation of the switching system 202. For example, in an embodiment, following a predetermined duration of time after incrementing or decrementing a counter, the switching system 202 may transition from the active state to the inactive state while a predetermined numerical value is not achieved. Alternatively, the stationary well tool 462 may perform one or more wellbore servicing operations (e.g., actuate an electronic actuator) in response to the counter transitioning to a predetermined numerical value (e.g., a threshold value).

In an additional or alternative embodiment, the switching system 202 of one or more of the stationary well tools 462 is configured such that the stationary receiving well tool 462 will remain in the active state (e.g., providing power to the electrical load 208) until receiving a second triggering signal. For example, the switching system 202 is configured to activate the power disconnection portion 212 in response to a second triggering signal to deactivate the feedback portion 210, as previously disclosed.

In an additional or alternative embodiment, the stationary receiving well tool 462 comprises a transducer, the switching system 202 may transition from the active state to the inactive state in response to one or more wellbore conditions. For example, upon activating the transducer (e.g., via activating the switching system 202), the transducer (e.g., a temperature sensor) may obtain data (e.g., temperature data) from within the wellbore 114 and the stationary receiving well tool 462 may transition from the active state to the inactive state until one or more wellbore conditions are satisfied (e.g., a temperature threshold). Alternatively, the duration of time necessary for the switching system 202 to transition from the active state to the inactive state may be a function of data obtained from within the wellbore 114.

In an additional or alternative embodiment, an additional well tool (e.g., a ball, a dart, a wire line tool, a work string member, etc.) may be introduced to the wellbore servicing system 460 (e.g., within the casing string 190) and may be employed to perform one or more wellbore servicing operations. For example, the additional well tool may engage the stationary receiving well tool 462 and may actuate (e.g., further actuate) the stationary receiving well tool 462 to perform one or more wellbore servicing operations. As such, one or more the transitory transmitting well tool 464 may be employed to incrementally adjust a stationary receiving well tool 462, for example, to adjust a flowrate and/or degree of restriction (e.g., to incrementally open or close) of the stationary receiving well tool 462 in a wellbore production environment.

In an embodiment, one or more steps of such a wellbore stimulation operation may be repeated. For example, one or more additional transitory transmitting well tool 464 may be introduced in the wellbore 114 and may transmit one or more triggering signals to one or more of the stationary receiving well tools 462, for example, for the purpose of providing power to one or more additional electrical load 208 (e.g., actuators, transducers, electronic circuits, transmitter systems, receiver systems, etc.).

Figure 11:
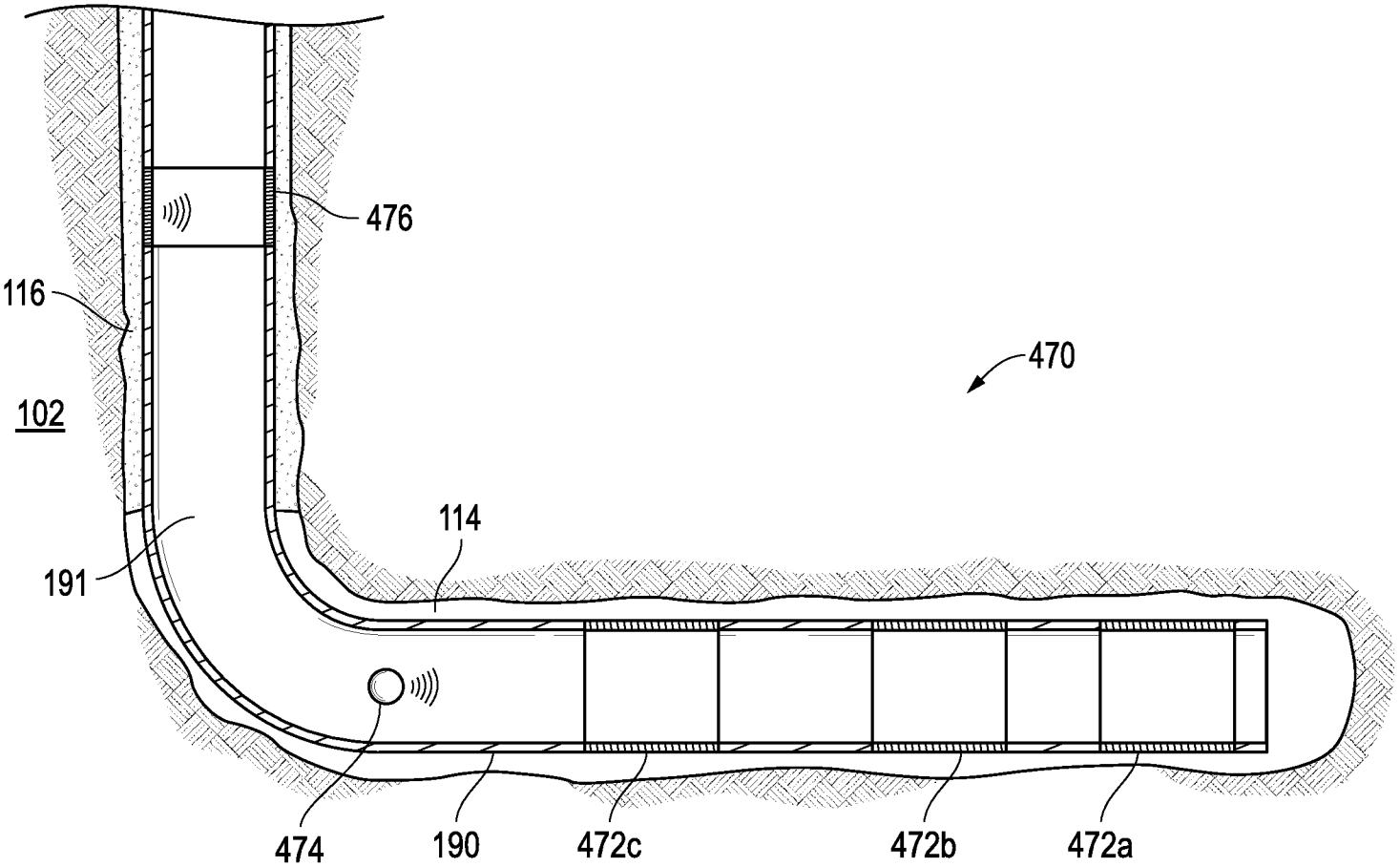

Referring to FIG. 11, another embodiment of a wellbore servicing system having at least two nodes communicating via a triggering signal is illustrated. In the embodiment of FIG. 11 the wellbore servicing system comprises an embodiment of a wellbore servicing system 470, for example, a system generally configured for the stimulation of one or more zones of a subterranean formation. Additionally or alternatively, the wellbore servicing system 470 may be configured to log/measure data from within a wellbore or any other suitable wellbore servicing operation as will be appreciated by one of ordinary skill in the art upon viewing this disclosure.

In the embodiment of FIG. 11, the wellbore servicing system 470 comprises a transitory transceiver well tool 474 (e.g., a ball or dart, for example, each comprising a receiver system, as disclosed with respect to FIG. 3, and a transmitter system, as disclosed with respect to FIG. 9) and one or more stationary receiving well tools 472 (particularly, three stationary receiving well tools, 472*a*, 472*b*, and 472*c*, for example, comprising a receiver system, as disclosed with respect to FIG. 3) disposed within the wellbore 114. While the embodiment of FIG. 11 illustrates an embodiment in which there are three stationary receiving well tools 472, in another embodiment any suitable number of stationary receiving well tools may be employed.

In the embodiment of FIG. 11, each of the stationary receiving well tools 472 is incorporated within (e.g., a part of) the casing string 190 and is positioned within the wellbore 114. In an embodiment, each of the stationary receiving well tools 472 is positioned within the wellbore such that each of the stationary receiving well tools 472 is generally associated with a subterranean formation zone. In such an embodiment, each of the stationary receiving well tools 472*a*, 472*b*, and 472*c*, may thereby obtain and/or comprise data relevant to or associated with each of zones, respectively. In an alternative embodiment, one or more of the stationary receiving well tools 472 may be configured to measure and/or to log data from within the wellbore 114. For example, one or more of the stationary receiving well tool 472 may comprise one or more transducers and/or a memory device. Alternatively, one or more of the stationary receiving well tools 472 may be configured to perform any other suitable wellbore servicing operation as will be appreciated by one of ordinary skill in the art upon viewing this disclosure.

Also in the embodiment of FIG. 11, the wellbore servicing system 470 further comprises a transmitting activation well tool 476 (e.g., comprising a transmitter system, as disclosed with respect to FIG. 9). In the embodiment of FIG. 11, the transmitting activation well tool 476 is generally configured to transmit a triggering signal to the transitory transceiver well tool 474. In the embodiment of FIG. 11, the transmitting activation well tool 476 is incorporated within the casing string 190 at a location uphole relative to the stationary receiving well tools 472 (e.g., uphole from the "heel" of the wellbore 114, alternatively, substantially near the surface 104). Alternatively, a transmitting activation well tool 476 may be positioned at the surface (e.g., not within the wellbore). For example, the transmitting activation well tool 476 may be a handheld device, a mobile device, etc. Alternatively, the transmitting activation well tool 476 may be and/or incorporated with a rig-based device, an underwater device, or any other suitable device as would be appreciated by one of ordinary skill in the art upon viewing this disclosure.

Also in the embodiment of FIG. 11, the wellbore servicing system 470 comprises a transitory transceiver well tool 474 (e.g., comprising a receiver system, as disclosed with respect to FIG. 3, and a transmitter system, as disclosed with respect to FIG. 9). In the embodiment of FIG. 11, the transitory transceiver well tool 474 is generally configured to receive a triggering signal from the transmitting activation well tool 476 and thereby transition the transitory transceiver well tool 474 from an inactive state to an active state. Additionally, upon transitioning to the active state, the transitory transceiver well tool 474 is generally configured to transmit one or more triggering signals to one or more of the stationary receiving well tools 472 effective to activate the switching system of one or more of the stationary receiving well tools 472 to output a given response, for example, to actuate the stationary receiving well tool 472. Alternatively, the transitory transceiver well tool 474 is generally configured to transmit one or more NFC signals, RFID signals, a magnetic signal, or any other suitable wireless signal as would be appreciated by one of ordinary skill in the art upon viewing this disclosure. In the embodiment of FIG. 11, the transitory transceiver well tool 474 comprises a ball, for example, such that the transitory transceiver well tool 474 may be communicated through the casing string 190 via the axial flowbore 191 thereof.

In an embodiment, the wellbore servicing system such as the wellbore servicing system 470 disclosed with respect to FIG. 11 may be employed to provide a two stage activation of one or more well tools (e.g., the transitory transceiver well tool). In an alternative embodiment, the wellbore servicing system 470 may be employed to measure and/or to log data, for example, for data collection purposes. Alternatively, the wellbore servicing system 470 may be employed perform to any other suitable wellbore servicing operation as will be appreciated by one of ordinary skill in the art upon viewing this disclosure. For example, such a wellbore servicing method may generally comprise the steps of positioning one or more stationary receiving well tools within a wellbore, providing an transmitting activation well tool, communicating a transitory transceiver well tool through at least a portion of the wellbore, sensing a first triggering signal to activate a switching system of the transitory transceiver well tool, sensing a second triggering signal to activate a switching system of one or more of the stationary receiving well tools, and optionally, repeating the process of activating a switching system of one or more additional stationary receiving well tools, for example, via one or more additional transitory transceiver well tools.

Referring again to FIG. 11, in an embodiment, one or more stationary receiving well tools 472 may be positioned within a wellbore, such as wellbore 114. For example, in the embodiment of FIG. 11 where the stationary receiving well tools 472 are incorporated within the casing string 190, the stationary receiving well tools 472 may be run into the wellbore 114 (e.g., positioned at a desired location within the wellbore 114) along with the casing string 190. Additionally, during the positioning of the stationary receiving well tools 472, the stationary receiving well tools 472 are in the inactive state.

Additionally, in an embodiment, one or more transmitting activation well tools 476 may be positioned within a wellbore, such as wellbore 114. For example, in the embodiment of FIG. 11 the transmitting activation well tool 476 is incorporated within the casing string 190, the transmitting activation well tool 476 may be run into the wellbore 114 (e.g., positioned at an uphole location with respect to one or more stationary receiving well tools 472 within the wellbore 114) along with the casing string 190. In such an embodiment, the transmitting activation well tool 476 is configured to transmit a first triggering signal.

In an embodiment, a transitory transceiver well tool 474 may be introduced into the wellbore 114 (e.g., into the casing string 190) in an inactive state and communicated downwardly through the wellbore 114. For example, in an embodiment, the transitory transceiver well tool 474 may be communicated downwardly through the wellbore 114, for example, via the movement of a fluid into the wellbore 114 (e.g., the forward-circulation of a fluid). As the transitory transceiver well tool 474 is communicated through the wellbore 114, the transitory transceiver well tool 474 comes into signal communication with the transmitting activation well tool 476. In an embodiment, as the transitory transceiver well tool 474 comes into signal communication with the transmitting activation well tools 476, the transitory transceiver well tool 474 may experience and/or receive the first triggering signal from the transmitting activation well tool 476. In an alternative embodiment, the transitory transceiver well tool 474 may be activated at the surface (e.g., prior to being disposed within the wellbore 114), for example, where the transmitting activation well tool 474 is a handheld device, a mobile device, etc.

In an embodiment, the triggering signal may be sufficient to activate the transitory transceiver well tool 474. For example, the switching systems 202 of the transitory transceiver well tool 474 may transition from the inactive state to the active state in response to the triggering signal. In such an embodiment, upon activating the transitory transceiver well tool 474, the switching system 202 may provide power to the electrical load 208 coupled with the transitory transceiver well tool 474. For example, the transitory transceiver well tool 474 comprises a transmitter system 400 which begin generating and/or transmitting a second triggering signal in response to receiving power from the switching system 202.

In an embodiment, the second triggering signal may be sufficient to activate one or more stationary receiving well tools 472. For example, one or more switching systems 202 of the stationary receiving well tools 472 may transition from the inactive state to the active state in response to the triggering signal. In such an embodiment, upon activating a stationary receiving well tool 472, the stationary receiving well tool 472 may provide power to the electrical load 208 coupled with the stationary receiving well tool 472. For example, the electrical load 208 may comprise an electronic actuator which actuates (e.g., from a closed position to an open position or vice-versa) in response to receiving power from the switching system 202. As such, upon actuation of the electronic actuator, the stationary receiving tool 472 may transition from a first configuration to a second configuration, for example, via the transitioning one or more components (e.g., a valve, a sleeve, a packer element, etc.) of the stationary receiving well tool 472. Alternatively, the electrical load 208 may comprise a transducer and/or a microcontroller which measures and/or logs wellbore data in response to receiving power from the switching system 202. Alternatively, the electrical load 208 may comprise a transmitting system (e.g., transmitting system 400) and may begin communicating a signal (e.g., a triggering signal, a NFC signal, a RFID signal, etc.) in response to providing power to the electrical load 208. Alternatively, the stationary receiving well tool 472 may employ any suitable electrical load 208 as would be appreciated by one of ordinary skill in the art upon viewing this disclosure.

In an embodiment, one or more steps of such a wellbore stimulation operation may be repeated. For example, one or more additional transitory transceiver well tool 474 may be introduced in the wellbore 114 in an inactive state and may become activated to transmit one or more triggering signals to one or more of the stationary receiving well tools 472, for example, for the purpose of providing power to one or more additional electrical load 208 (e.g., actuators, transducers, electronic circuits, transmitter systems, receiver systems, etc.).

Figure 12:
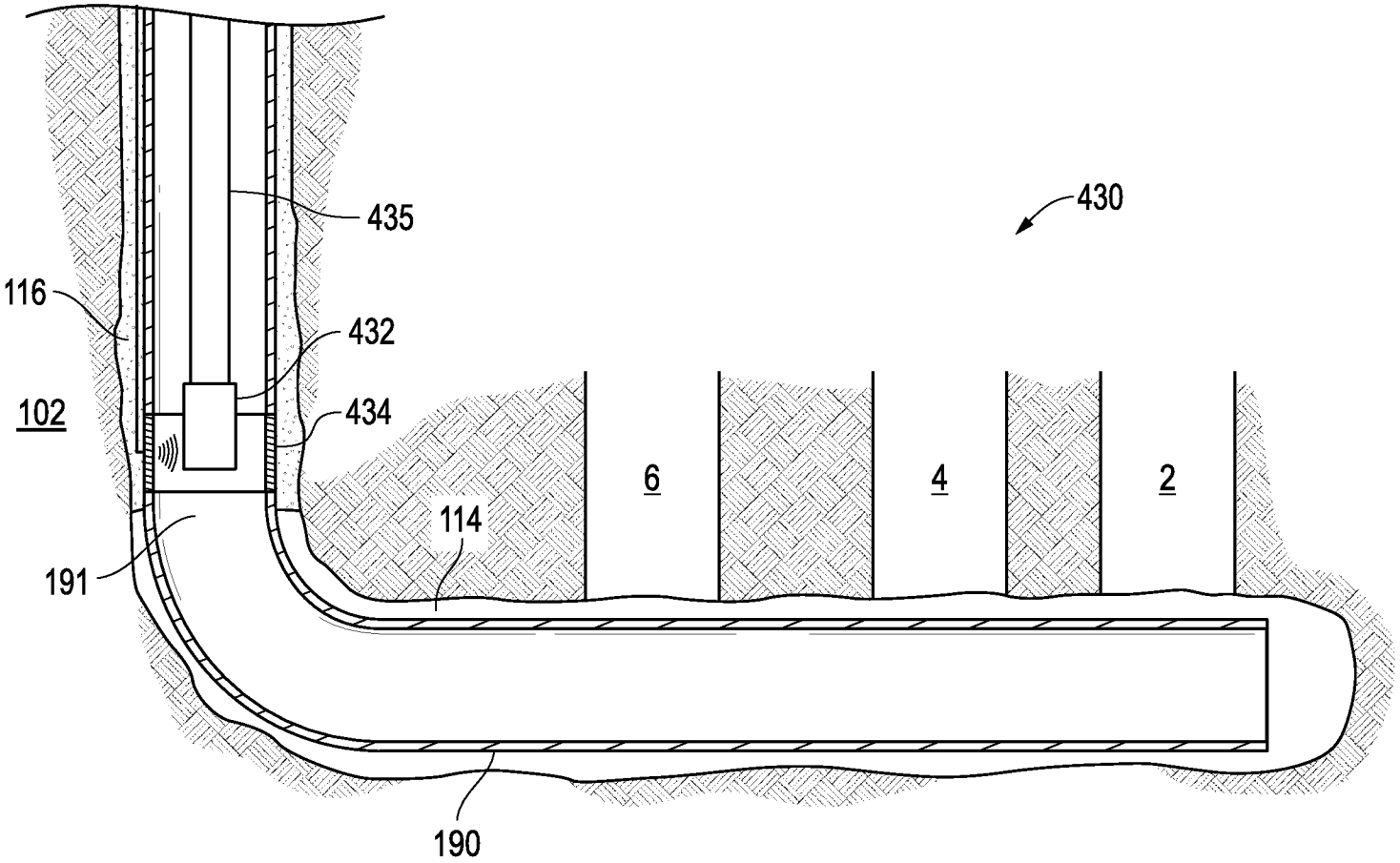

Referring to FIG. 12, another embodiment of a wellbore servicing system having a receiving well tool and a transmitting well tool communicating via a triggering signal is illustrated. In the embodiment of FIG. 12, the wellbore servicing system comprises an embodiment of a wellbore servicing system 430, for example, a system generally configured for the stimulation of one or more zones of a subterranean formation, for example, a perforating system.

In the embodiment of FIG. 12, the wellbore servicing system 430 comprises a transitory receiving well tool 432 (e.g., comprising a receiver system, as disclosed with respect to FIG. 3) incorporated within a work string 435 (e.g., a coiled tubing string, a jointed tubing string, or combinations thereof). Alternatively, the transitory receiving well tool 432 may be similarly incorporated within (e.g., attached to or suspended from) a wireline (e.g., a slickline, a sandline, etc.) or the like. In the embodiment of FIG. 12, the transitory receiving well tool 432 may be configured as a perforating tool, for example, a perforating gun. In such an embodiment, the transitory receiving well tool 432 (e.g., a perforating gun) may be configured to perforate a portion of a well and/or a tubular string (e.g., a casing string) disposed therein. For example, in an embodiment, the perforating gun may comprise a plurality of shaped, explosive charges which, when detonated, will explode outwardly into the tubular string and/or formation so as to form a plurality of perforations.

In the embodiment of FIG. 12, the wellbore servicing system 430 also comprises a transmitting activation well tool 434 e.g., comprising a transmitter system, as disclosed with respect to FIG. 9). In the embodiment of FIG. 12, the transmitting activation well tool 434 is incorporated within the casing string 190 at desired location within the wellbore 114. For example, various embodiments, the transmitting activation well tool 434 may be located at a depth slightly above or substantially proximate to a location at which it is desired to introduce a plurality of perforations. Alternatively, the transmitting activation well tool 434 may be located at any suitable depth within the wellbore 114 or distance along a wellbore 114 (e.g., a horizontal portion of a wellbore), for example, a depth of about 100 ft., alternatively, about 250 ft., alternatively, about 500 ft., alternatively, about 750 ft., alternatively, about 1,000 ft., alternatively, about 1,500 ft., alternatively, about 2,000 ft., alternatively, about 2,500 ft., alternatively, about 3,000 ft., alternatively, about 4,000 ft., alternatively, about 5,000 ft. In an additional embodiment, a wellbore servicing system may comprise one or more additional activation well tools, like the transmitting activation well tool 434, incorporated within the casing string at various locations.

In an embodiment, a wellbore servicing system such as the wellbore servicing system 460 disclosed with respect to FIG. 12 may be employed for the stimulation of one or more zones of a subterranean formation, for example, a perforating system. For example, such a wellbore servicing method may generally comprise the steps of positioning a transmitting activation well tool within a wellbore, communicating a transitory receiving well tool through at least a portion of the wellbore, sensing a triggering signal to activate a switching system of the transitory receiving well tool, and retrieving the transitory receiving well tool to deactivate the transitory receiving well tool.

In an embodiment, one or more transmitting activation well tools 434 may be positioned within a wellbore, such as wellbore 114. For example, in the embodiment of FIG. 12 the transmitting activation well tool 434 is incorporated within the casing string 190, the transmitting activation well tool 434 may be run into the wellbore 114 (e.g., positioned at a desired location within the wellbore 114) along with the casing string 190. In such an embodiment, the transmitting activation well tool 434 is configured to transmit a triggering signal.

In an embodiment, a transitory receiving well tool 432 may be introduced in the wellbore 114 (e.g., into the casing string 190) in an inactive state and communicated downwardly through the wellbore 114. For example, in an embodiment, the transitory receiving well tool 432 may be communicated downwardly through the wellbore 114, for example, via the movement of a work string 435 into the wellbore 114. As the transitory receiving well tool 432 is communicated through the wellbore 114, the transitory receiving well tool 432 comes into signal communication with the transmitting activation well tool 434. In an embodiment, as the transitory receiving well tool 432 comes into signal communication with the transmitting activation well tools 434, the transitory receiving well tool 432 may experience and/or receive the triggering signal from the transmitting activation well tool 432.

In an embodiment, the triggering signal may be sufficient to activate the transitory receiving well tools 432. For example, the switching systems 202 of the transitory receiving well tool 432 may transition from the inactive state to the active state in response to the triggering signal. In such an embodiment, upon activating the transitory receiving well tool 432, the switching system 202 may provide power to the electrical load 208 coupled with the transitory receiving well tool 432. For example, the electrical load 208 may comprise a perforating gun which may be activated (e.g., capable of firing) in response to receiving power from the switching system 202. Alternatively, the transitory receiving tool 432 may employ any suitable electrical load 208 as would be appreciated by one of ordinary skill in the art upon viewing this disclosure. Additionally, upon providing power to the electrical load 208, the transitory receiving well tool 432 may perform one or more wellbore servicing operations, for example, perforating the casing string 190.

In an embodiment, upon the completion of one or more wellbore servicing operations, the transitory receiving well tool 432 may be communicated upwardly through the wellbore 114. As the transitory receiving well tool 432 is communicated upwardly through the wellbore 114, the transitory receiving well tool 432 comes into signal communication with the transmitting activation well tool 434. In an embodiment, as the transitory receiving well tool 432 comes into signal communication with the transmitting activation well tools 434, the transitory receiving well tool 432 may experience and/or receive a second triggering signal from the transmitting activation well tool 432. In an embodiment, the triggering signal may be sufficient to transition the transitory receiving well tool 432 to the inactive state (e.g., to deactivate the transitory receiving well tool 432 such that the perforating gun is no longer capable of firing). For example, the switching systems 202 of the transitory receiving well tool 432 may transition from the active state to the inactive state in response to the second triggering signal.

In an embodiment, one or more steps of such a wellbore stimulation operation may be repeated. For example, one or more additional transitory receiving well tool 432 may be introduced in the wellbore 114 in an inactive state and may be activated to perform one or more wellbore servicing operations. Following one or more wellbore servicing operations the transitory receiving well tool 432 may be transitioned to the inactive state upon being retrieved from the wellbore 114.

In an embodiment, a well tool, a wellbore servicing system comprising one or more well tools, a wellbore servicing method employing such a wellbore servicing system and/or such a well tool, or combinations thereof may be advantageously employed in the performance of a wellbore servicing operation. In an embodiment, as previously disclosed, employing such a well tool comprising a switching system enables an operator to further reduce power consumption and increase service life of a well tool. Additionally, as previously disclosed, employing such a well tool comprising a switching system enables an operator to increase safety during the performance of one or more hazardous or dangerous wellbore servicing operations, for example, explosive detonation, perforation, etc. For example, a well tool may be configured to remain in an inactive state until activated by a triggering signal. Conventional, well tools and/or wellbore servicing systems may not have the ability to wirelessly induce an electrical response to complete a switching circuit and thereby transition from an inactive state where substantially no power (e.g., less power consumed than a "sleep" or idle state) is consumed to an active state. As such, a switching system may be employed to increase the service life of a well tool, for example, to allow a well tool to draw substantially no power until activated (e.g., via a triggering signal) to perform one or more wellbore servicing operations and thereby increasing the service life of the well tool. Additionally, such a switching system may be employed to increase safety during the performance of one or more hazardous or dangerous wellbore servicing operations, for example, to allow an operator to activate hazardous equipment remotely.

Additional Embodiments

The following are non-limiting, specific embodiments in accordance with the present disclosure:

A first embodiment, which is a wellbore tool comprising:
- a power supply;
- an electrical load;
- a receiving unit configured to passively receive a triggering signal; and
  - a switching system electrically coupled to the power supply, the receiving unit, and the electrical load,
  - wherein the switching system is configured to selectively transition from an inactive state to an active state in response to the triggering signal, from the active state to the active state in response to the triggering signal, or combinations thereof;
- wherein in the inactive state a circuit is incomplete and any route of electrical current flow between the power supply and the electrical load is disallowed; and
  - wherein in the active state the circuit is complete and at least one route of electrical current flow between the power supply and the electrical load is allowed.

A second embodiment, which is the wellbore tool of the first embodiment, wherein the switching system comprises a rectifier portion configured to convert the triggering signal to a rectified signal.

A third embodiment, which is the wellbore tool of the second embodiment, wherein the switching system comprises a triggering portion and a power switching portion, wherein the triggering portion is configured to activate the power switching portion in response to the rectified signal.

A fourth embodiment, which is the wellbore tool of one of the first through the third embodiments, wherein the switching system comprises a triggering portion and a power switching portion, wherein the triggering portion is configured to activate the power switching portion in response to the triggering signal.

A fifth embodiment, which is the wellbore tool of one of the first through the fourth embodiments, wherein the switching system comprises a feedback portion configured to retain the power switching portion in an active state.

A sixth embodiment, which is the wellbore tool of one of the first through the fifth embodiments, wherein the switching system comprises a power disconnection portion configured to deactivate the power switching portion.

A seventh embodiment, which is the wellbore tool of one of the first through the sixth embodiments, wherein the receiving unit is an antenna.

An eighth embodiment, which is the wellbore tool of one of the first through the seventh embodiments, wherein the receiving unit is a passive transducer.

A ninth embodiment, which is the wellbore tool of one of the first through the eighth embodiments, wherein the electrical load is a microprocessor.

A tenth embodiment, which is the wellbore tool of one of the first through the ninth embodiments, wherein the electrical load is an electronically actuatable valve.

An eleventh embodiment, which is the wellbore tool of one of the first through the tenth embodiments, wherein the electrical load is a transmitter system.

A twelfth embodiment, which is the wellbore tool of one of the first through the eleventh embodiments, wherein the electrical load is a detonator.

A thirteenth embodiment, which is the wellbore tool of one of the first through the twelfth embodiments, wherein the wellbore servicing tool is disposed within a ball or a dart.

A fourteenth embodiment, which is the wellbore tool of one of the first through the thirteenth embodiments, wherein the wellbore servicing tool is configured such that upon receiving the triggering signal the receiving unit generates an electrical response effective to activate one or more electrical switches of the switching system to complete one or more circuits and, thereby configure the switching system to allow a route of electrical current flow between the power supply and the electrical load.

A fifteenth embodiment, which is a wellbore servicing system comprising:

one or more stationary receiving well tools disposed within a wellbore;

wherein the stationary receiving well tools are configured to selectively transition from an inactive state to an active state in response to a triggering signal;

wherein in the inactive state a circuit is incomplete and current flow between the power supply and the electrical load is disallowed; and wherein in the active state the circuit is complete and electrical current flow between the power supply and the electrical load is allowed; and a transitory transmitting well tool configured to be communicated through at least a portion of the wellbore, wherein the transitory transmitting well tool is configured to transmit the triggering signal to one or more stationary receiving well tools.

A sixteenth embodiment, which is the wellbore servicing system of the fifteenth embodiment, wherein the transitory transmitting well tool is a ball or dart.

A seventeenth embodiment, which is the wellbore servicing system of one of the fifteenth through the sixteenth embodiments, wherein the transitory transmitting well tool is a member attached to a coiled-tubing string or a member attached to a wireline.

An eighteenth embodiment, which is the wellbore servicing system of one of the fifteenth through the seventeenth embodiments, wherein the stationary receiving well tools are each configured to transition from the inactive state to the active state in response to the triggering signal.

A nineteenth embodiment, which is the wellbore servicing system of the eighteenth embodiment, wherein the stationary receiving well tools are each configured to perform one or more wellbore servicing operations in response to transitioning to the active state.

A twentieth embodiment, which is a wellbore servicing method comprising:

positioning one or more stationary receiving well tools within a wellbore;

wherein the stationary receiving well tools are each configured to selectively transition from an inactive state to an active state in response to a triggering signal;

wherein in the inactive state a circuit is incomplete and any route of electrical current flow between the power supply and the electrical load is disallowed; and wherein in the activate state the circuit is complete and at least one route of electrical current flow between the power supply and the electrical load is allowed;

communicating a transitory transmitting well tool through the wellbore such that the transitory transmitting well tool comes into signal communication with at least one of the one or more stationary receiving well tools;

wherein the transitory transmitting well tool communicates with at least one of the one or more stationary receiving well tools via one or more triggering signals; and sensing the triggering signal to transition one or more stationary receiving well tools to the active state.

A twenty-first embodiment, which is the wellbore servicing method of the twentieth embodiment, further comprising performing one or more wellbore servicing operations in response to transitioning to the active state.

A twenty-second embodiment, which is the wellbore servicing method of one of the twentieth through the twenty-first embodiments, wherein transitioning from an inactive state to an active state in response to a triggering signal comprises the steps of:

receiving a triggering signal;

converting the triggering signal to a direct current signal and thereby generating a rectified signal; and applying the rectified signal to a first electronic switch and thereby activating the first electronic switch;

wherein activating the first electronic switch allows a first route of electrical current flow; and wherein allowing the first route of electrical current flow activates a second electronic switch and thereby allowing a route of electrical current flow between a power supply and an electrical load.

A twenty-third embodiment, which is the wellbore servicing method of the twenty-second embodiment, further comprising the steps of:

diverting at least a portion of the current flowing from the power source to the electrical load to generate an electrical voltage;

applying the electrical voltage to a third electronic switch and thereby activating the third electronic switch;

wherein activating the third electronic switch allows a second route of electrical current flow; and wherein allowing the second route of electrical current flow configures the second electronic switch to remain active.

A twenty-fourth embodiment, which is the wellbore servicing method of the twenty-third embodiment, further comprising the steps of:

applying a voltage signal to a fourth electronic switch and thereby activating the fourth electronic switch;

wherein activating the fourth electronic switch allows a route of electrical current flow; and wherein allowing the route of electrical current flow deactivates the third electronic switch and thereby disallowing a route of electrical current flow between a power supply and an electrical load.

A twenty-fifth embodiment, which is a wellbore system comprising:

a transmitting activation well tool disposed within a wellbore, wherein the transmitting activation well tool is configured to communicate a triggering signal; and a transitory transceiver well tool configured for movement through the wellbore;

wherein the transitory transceiver well tool is configured to receive one or more triggering signals;

wherein, prior to communication with the transmitting activation well tool, the transitory transceiver well tool is in an inactive state;

wherein the transitory transceiver well tool is configured to transition to an active state in response to receiving a first triggering signal; and wherein, in the active state, the transitory transceiver well tool is configured to transmit a second triggering signal; and one or more stationary receiving well tools disposed within the wellbore;

wherein the stationary receiving well tools are each are configured to selectively transition between an inactive state and an active state in response to the second triggering signal;

wherein in the inactive state a circuit is incomplete and any route of electrical current flow between the power supply and the electrical load is disallowed; and wherein in the activate state the circuit is complete and at least one route of electrical current flow between the power supply and the electrical load is allowed.

A twenty-sixth embodiment, which is the wellbore system of the twenty-fifth embodiment, wherein the stationary receiving well tools are each configured to perform one or more wellbore servicing operations in response to transitioning to the active state.

A twenty-seventh embodiment, which is a wellbore servicing method comprising:

positioning an activation well tool within a wellbore, wherein the activation well tool is configured to communicate a first triggering signal;

positioning one or more stationary well tools within a wellbore;

wherein the stationary well tools are each configured to selectively transition from an inactive state to an active state in response to a second triggering signal;

wherein in the inactive state a circuit is incomplete and any route of electrical current flow between the power supply and the electrical load is disallowed; and wherein in the activate state the circuit is complete and at least one route of electrical current flow between the power supply and the electrical load is allowed;

communicating a transitory well tool through the wellbore such that the transitory well tool comes into signal communication with the activation well tool;

wherein the transitory well tool is in an inactive state;

sensing the first triggering signal to transition the transitory well tool from the inactive state to an active state in response to a first triggering signal and thereby configures the transitory well tool to transmit the second triggering signal; and sensing the second triggering signal allow to a route electrical current flow between a power supply and an electrical load in response to the second triggering signal.

A twenty-eighth embodiment, which is the wellbore servicing method of the twenty-seventh embodiment, further comprising performing one or more wellbore servicing operations in response to transitioning one or more stationary well tools to the active state.

A twenty-ninth embodiment, which is a wellbore servicing system comprising:

a transmitting activation well tool disposed within a wellbore, wherein the transmitting activation well tool is configured to communicate a triggering signal; and a transitory receiving well tool configured for movement through the wellbore;

wherein the transitory receiving well tool is configured to receive one or more triggering signals;

wherein, prior to communication with the transmitting activation well tool, the transitory receiving well tool is in an inactive state such that a switching circuit is incomplete and any route electrical current flow between the power supply and an electrical load is disallowed; and wherein the transitory receiving well tool is configured to transition to an active state such that the switching circuit is complete and at least one route electrical current flow between the power supply and the electrical load is allowed in response to receiving a first triggering signal.

A thirtieth embodiment, which is the wellbore servicing system of the twenty-ninth embodiment, wherein the transitory receiving well tool is further configured to transition to the inactive state in response to receiving a second triggering signal.

A thirty-first embodiment, which is the wellbore servicing system of the thirtieth embodiment, wherein the transitory receiving well tool is configured to perforate a portion of a wellbore or tubular string.

A thirty-second embodiment, which is the wellbore servicing system of the thirty-first embodiment, wherein the transitory receiving well tool comprises a perforating gun.

A thirty-third embodiment, which is the wellbore servicing system of the thirty-second embodiment, wherein the perforating gun comprises a selectively detonable explosive charge.

A thirty-fourth embodiment, which is the wellbore servicing system of the thirty-third embodiment, wherein prior to receiving the first triggering signal, the explosive charge cannot be detonated and after receiving the first triggering signal, the explosive charge can be detonated.

A thirty-fifth embodiment, which is the wellbore servicing system of one of the twenty-ninth through the thirty-fourth embodiments, wherein the transmitting activation well tool is incorporated within a tubular string in the wellbore.

A thirty-sixth embodiment, which is the wellbore servicing system of one of the twenty-ninth through the thirty-fifth embodiments, wherein the transitory receiving well tool is a member attached to a coil-tubing string or a member attached to a wireline.

A thirty-seventh embodiment, which is the wellbore servicing system of one of the twenty-ninth through the thirty-sixth embodiments, wherein when the transitory receiving well tool is in the inactive state, the transitory receiving well tool is configured to disallow a route of electrical current flow between a power supply and an electrical load.

A thirty-eighth embodiment, which is the wellbore servicing system of one of the twenty-ninth through the thirty-seventh embodiments, wherein when the transitory receiving well tool is in the active state, the transitory receiving well tool is configured to allow a route of electrical current flow between a power supply and an electrical load.

A thirty-ninth embodiment, which is a wellbore servicing system comprising:

a transmitting deactivation well tool disposed within a wellbore, wherein the transmitting deactivation well tool is configured to communicate a triggering signal; and a transitory receiving well tool configured for movement through the wellbore;

wherein the transitory receiving well tool is configured to receive one or more triggering signals;

wherein, prior to communication with the transmitting activation well tool, the transitory receiving well tool is in an active state such that a switching circuit is complete and at least one route electrical current flow between the power supply and the electrical load is allowed; and wherein the transitory receiving well tool is configured to transition to an inactive state such that a switching circuit is incomplete and any route electrical current flow between the power supply and an electrical load is disallowed in response to receiving a first triggering signal.

A fortieth embodiment, which is the wellbore servicing system of the thirty-ninth embodiment, wherein the transitory receiving well tool is further configured to transition to the active state in response to receiving a second triggering signal.

A forty-first embodiment, which is the wellbore servicing system of the fortieth embodiment, wherein the transitory receiving well tool is configured to perforate a portion of a wellbore or tubular string.

A forty-second embodiment, which is the wellbore servicing system of the forty-first embodiment, wherein the transitory receiving well tool comprises a perforating gun.

A forty-third embodiment, which is the wellbore servicing system of the forty-second embodiment, wherein the perforating gun comprises a selectively detonable explosive charge.

A forty-fourth embodiment, which is the wellbore servicing system of the forty-third embodiment, wherein prior to receiving the first triggering signal, the explosive charge can be detonated and after receiving the first triggering signal, the explosive charge cannot be detonated.

A forty-fifth embodiment, which is the wellbore servicing system of one of the thirty-ninth through the forty-fourth embodiments, wherein the transmitting activation well tool is incorporated within a tubular string in the wellbore.

A forty-sixth embodiment, which is the wellbore servicing system of one of the thirty-ninth through the forty-fifth embodiments, wherein the transitory receiving well tool is a member attached to a coil-tubing string or a member attached to a wireline.

A forty-seventh embodiment, which is the wellbore servicing system of one of the thirty-ninth through the forty-sixth embodiments, wherein when the transitory receiving well tool is in the inactive state, the transitory receiving well tool is configured to disallow a route of electrical current flow between a power supply and an electrical load.

A forty-eighth embodiment, which is the wellbore servicing system of one of the thirty-ninth through the forty seventh embodiments, wherein when the transitory receiving well tool is in the active state, the transitory receiving well tool is configured to allow a route of electrical current flow between a power supply and an electrical load.

A forty-ninth embodiment, which is a wellbore servicing method comprising:

positioning a transmitting activation well tool within a wellbore, wherein the transmitting activation well tool is configured to communicate a triggering signal; and communicating a transitory receiving well tool through the wellbore such that the transitory receiving well tool comes into signal communication with the transmitting activation well tool;

wherein the transitory receiving well tool is configured in an inactive state such that a switching circuit is incomplete and any route of electrical current flow between a power supply and an electrical load is disallowed;

sensing the triggering signal to transition the transitory receiving well tool from the inactive state to an active state in response to a first triggering signal;

wherein in the active state the switching circuit is complete and at least one route of electrical current flow between a power supply and an electrical load is allowed;

retrieving the transitory receiving well tool, wherein in response to a second triggering signal the transitory well tool transitions to the inactive state.

A fiftieth embodiment, which is the wellbore servicing method of the forty-ninth embodiment, wherein the transitory receiving well tool comprises a perforating gun comprising a selectively detonatable explosive charge.

A fifty-first embodiment, which is the wellbore servicing method of the fiftieth embodiment, wherein, prior to communication with the transmitting activation well tool, the explosive charge cannot be detonated and, after communication with the transmitting activation well tool, the explosive charge can be detonated.

A fifty-second embodiment, which is the wellbore servicing method of the fifty-first embodiment, further comprising positioning the perforating gun proximate to a portion of the wellbore and/or a tubular string into which one or more perforations are to be introduced.

A fifty-third embodiment, which is the wellbore servicing method of the fifty-second embodiment, further comprising causing the explosive charge to detonate.

A fifty-fourth embodiment, which is the wellbore servicing method of the fifty-third embodiment, wherein the transmitting activation well tool is positioned within the wellbore proximate to a portion of the wellbore and/or a tubular string into which one or more perforations are to be introduced.

A fifty-fifth embodiment, which is the wellbore servicing method of one of the forty-ninth through the fifty-fourth embodiments, wherein when the transitory receiving well tool is in the inactive state, the transitory receiving well tool is configured to disallow a route of electrical current flow between a power supply and an electrical load.

A fifty-sixth embodiment, which is the wellbore servicing method of one of the forty-ninth through the fifty-fifth embodiments, wherein when the transitory receiving well tool is in the active state, the transitory receiving well tool is configured to allow a route of electrical current flow between a power supply and an electrical load.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore tool comprising:

a power supply;

an electrical load;

a receiving unit configured to passively receive a triggering signal using a device not electrically coupled to a source of electrical power and to convert the triggering signal to an electrical response; and a signal conditioning filter electrically coupled to the receiving unit, wherein the signal conditioning filter removes signals received by the receiving unit having a frequency outside of a determined frequency range;

a switching system comprising a first electronic switch, a second electronic switch and a third electronic switch, wherein the switching system is electrically coupled to the power supply and the electrical load, wherein the switching system is communicatively coupled to the receiving unit, and wherein the switching system receives the electrical response from the receiving unit;

wherein the switching system is configured to activate the first electronic switch using the electrical response to permit a first electrical current flow and to selectively transition from an inactive state to an active state in response to activating the first electronic switch, from the active state to the inactive state in response to activating the first electronic switch, or combinations thereof, wherein the switching system is configured to activate the second electronic switch using the first electrical current flow to permit a second current flow between the power supply and the electrical load, and wherein a portion of the second current flow is diverted to generate a first voltage, wherein the third electronic switch is activated using the first voltage to permit a third electrical current flow that maintains the second electronic switch in an activated state;

wherein in the inactive state a circuit is incomplete and any route of electrical current flow between the power supply and the electrical load is disallowed; and wherein in the active state the circuit is complete and at least one route of electrical current flow between the power supply and the electrical load is allowed.

2. The wellbore tool of claim 1, wherein the switching system comprises a rectifier portion configured to rectify the electrical response.

3. The wellbore tool of claim 2, wherein the switching system comprises a triggering portion and a power switching portion, wherein the triggering portion is configured to activate the power switching portion in response to activation of the first electronic switch using the rectified electrical response.

4. The wellbore tool of claim 1, wherein the switching system comprises a triggering portion and a power switching portion, wherein the triggering portion is configured to activate the power switching portion in response to activation of the first electronic switch.

5. The wellbore tool of claim 1, wherein the switching system comprises a power switching portion configured to transition between an active power switching state and an inactive power switching state, and wherein the switching system comprises a feedback portion configured to retain the power switching portion in the active power switching state.

6. The wellbore tool of claim 1, wherein the switching system comprises a power switching portion configured to transition between an active power switching state and an inactive power switching state and wherein the switching system comprises a power disconnection portion configured to transition the power switching portion from the active power switching state to the inactive power switching state.

7. The wellbore tool of claim 1, wherein the receiving unit comprises an antenna.

8. The wellbore tool of claim 1, wherein the receiving unit comprises a passive transducer.

9. The wellbore tool of claim 1, wherein the electrical load comprises a microprocessor.

10. The wellbore tool of claim 1, wherein the electrical load comprises an electronically actuatable valve.

11. The wellbore tool of claim 1, wherein the electrical load comprises a transmitter system.

12. The wellbore tool of claim 1, wherein the electrical load comprises a detonator.

13. A wellbore servicing system comprising:

a stationary receiving well tool disposed within a wellbore comprising a power supply, an electrical load, and a circuit for connecting the power supply to the electrical load, and a first electronic switch, a second electronic switch and a third electronic switch coupled to the circuit;

wherein the stationary receiving well tool comprises a receiver system, wherein the receiver system comprises a receiving unit, wherein the receiving unit is configured to passively receive a triggering signal using a device not electrically coupled to a source of electrical power, to convert the triggering signal to an electrical response, and to activate the first electronic switch using the electrical response to permit a first electrical current flow and to activate the second electronic switch using the first electrical current flow to permit a second current flow, wherein a portion of the second current flow is diverted to generate a first voltage, wherein a third electronic switch is activated using the first voltage to permit a third electrical current flow that maintains the second electronic switch in an activated state, and wherein the receiving unit is electrically coupled to a signal conditioning filter, and wherein the signal conditioning filter removes signals received by the receiving unit having a frequency outside of a determined frequency range;

wherein the stationary receiving well tool is configured to selectively transition from an inactive state to an active state in response to activating the electronic switch, from the active state to the inactive state in response to activating the electronic switch, or combinations thereof;

wherein in the inactive state the circuit is incomplete and current flow between the power supply and the electrical load is disallowed; and wherein in the active state the circuit is complete and electrical current flow between the power supply and the electrical load is allowed; and a transitory transmitting well tool configured to be communicated through at least a portion of the wellbore, wherein the transitory transmitting well tool is configured to transmit the triggering signal to the stationary receiving well tool.

14. The wellbore servicing system of claim 13, wherein the stationary receiving well tool is configured to perform one or more wellbore servicing operations in response to transitioning to the active state.

15. A wellbore servicing method comprising:

positioning a stationary receiving well tool within a wellbore, the stationary receiving well tool comprising a receiving unit, a power supply, an electrical load, a circuit for connecting the power supply to the electrical load, and a first electronic switch electrically coupled to the circuit;

communicating a transitory transmitting well tool through the wellbore such that the transitory transmitting well tool comes into signal communication with the stationary receiving well tool;

transmitting a triggering signal from the transitory transmitting well tool to the stationary receiving well tool;

passively receiving the triggering signal by the receiving unit using a device not electrically coupled to a source of electrical power;

converting the triggering signal to an electrical response, wherein a signal conditioning filter electrically coupled to the receiving unit removes signals received by the receiving unit having a frequency outside of a determined frequency range;

activating the first electronic switch using the electrical response;

transitioning the stationary receiving well tool from an inactive state to an active state in response to activating the first electronic switch, from the active state to the inactive state in response to activating the first electronic switch, or combinations thereof;

wherein in the inactive state the circuit is incomplete and current flow between the power supply and the electrical load is disallowed; and wherein in the active state the circuit is complete and electrical current flow between the power supply and the electrical load is allowed;

rectifying the electrical response, wherein the first electronic switch is activated using the rectified electrical response and wherein activating the first electronic switch permits a first electrical current flow;

activating a second electronic switch using the first electrical current flow, wherein activating the second electronic switch permits a second current flow between the power supply and the electrical load;

diverting at least a portion of the second current flow to generate a first voltage;

activating a third electronic switch by applying the first voltage to the third electronic switch, wherein activating the third electronic switch permits a third current flow; and maintaining the second electronic switch in an activated state using the third current flow.

16. The wellbore servicing method of claim 15, further comprising performing one or more wellbore servicing operations in response to transitioning to the active state.

17. The wellbore servicing method of claim 15, further comprising the steps of:

activating a fourth electronic switch by applying a second voltage to the fourth electronic switch;

wherein activating the fourth electronic switch permits a fourth current flow that deactivates the third electronic switch.

* * * * *